US006536524B1

(12) United States Patent
Snider

(10) Patent No.: US 6,536,524 B1
(45) Date of Patent: Mar. 25, 2003

(54) METHOD AND SYSTEM FOR PERFORMING A CASING CONVEYED PERFORATING PROCESS AND OTHER OPERATIONS IN WELLS

(75) Inventor: Philip M. Snider, Houston, TX (US)

(73) Assignee: Marathon Oil Company, Findlay, OH (US)

( * ) Notice: Subject to any disclaimer, the term of this patent is extended or adjusted under 35 U.S.C. 154(b) by 0 days.

(21) Appl. No.: 09/656,720

(22) Filed: Sep. 7, 2000

Related U.S. Application Data

(63) Continuation-in-part of application No. 09/586,648, filed on Jun. 1, 2000, and a continuation-in-part of application No. 09/300,056, filed on Apr. 27, 1999.

(51) Int. Cl.[7] ..... E21B 29/00

(52) U.S. Cl. ..... 166/297; 166/373; 166/55; 166/65.1

(58) Field of Search ..... 166/297, 298, 166/373, 55, 63, 65.1, 179

(56) References Cited

U.S. PATENT DOCUMENTS

| | | | |
|---|---|---|---|
| 3,684,008 | A | 8/1972 | Garrett |
| 4,023,167 | A | 5/1977 | Wahlstrom |
| 4,572,293 | A | 2/1986 | Wilson et al. |
| 4,599,182 | A | 7/1986 | Young et al. |
| 4,630,044 | A | 12/1986 | Polzer |
| 4,656,463 | A | 4/1987 | Anders et al. |
| 4,698,631 | A | 10/1987 | Kelly |
| 4,808,925 | A | 2/1989 | Baird |
| 4,827,395 | A | 5/1989 | Anders et al. |
| 5,105,742 | A | 4/1992 | Sumner |
| 5,142,128 | A | 8/1992 | Perkin et al. |
| 5,191,936 | A | 3/1993 | Edwards et al. |
| 5,202,680 | A | 4/1993 | Savage |
| 5,279,366 | A | 1/1994 | Scholes |
| 5,355,957 | A | 10/1994 | Burleson et al. |
| 5,361,838 | A | 11/1994 | Kilgore |
| 5,457,447 | A | 10/1995 | Ghaem et al. |
| 5,479,860 | A | 1/1996 | Ellis |
| 5,495,237 | A | 2/1996 | Yuasa et al. |
| 5,497,140 | A | 3/1996 | Tuttle |
| 5,505,134 | A | 4/1996 | Brooks et al. |

(List continued on next page.)

FOREIGN PATENT DOCUMENTS

| | | | |
|---|---|---|---|
| EP | 0 013 494 | A1 | 7/1980 |
| EP | 0 412 535 | B1 | 2/1991 |
| EP | 0 651 132 | A2 | 5/1995 |
| EP | 0 730 083 | A2 | 4/1996 |
| FR | 1.033.631 | | 7/1953 |
| SU | 1657627 | AI | 6/1991 |
| WO | WO01/18357 | A2 | 3/2001 |
| WO | WO01/73423 | A1 | 10/2001 |

OTHER PUBLICATIONS

DEN.CON Tool Co., General Catalog, 1994–1995, pp. 1–3.

*Primary Examiner*—David Bagnell
*Assistant Examiner*—Jennifer R. Dougherty
(74) *Attorney, Agent, or Firm*—Jack E. Ebel

(57) ABSTRACT

A method for performing operations and for improving production in a well includes the steps of: locating a process tool at a required depth in the well, placing a reader device in the well proximate to the process tool, and then transporting an identification device through the well past the reader device to actuate the reader device and control the tool. The reader device includes a transmitter configured to transmit rf signals to the identification device, a receiver configured to receive a unique rf code signal from the identification device, and a control circuit configured to control the tool responsive to reception of the unique rf code signal. In a first embodiment the tool comprises a casing conveyed perforating tool and a perforating process is performed. In a second embodiment the tool comprises a tubing conveyed packer setting tool and a packer setting process is performed.

65 Claims, 15 Drawing Sheets

U.S. PATENT DOCUMENTS

| | | | | |
|---|---|---|---|---|
| 5,608,199 | A | | 3/1997 | Clouse et al. |
| 5,626,192 | A | | 5/1997 | Connel et al. |
| 5,654,693 | A | | 8/1997 | Cocita |
| 5,660,232 | A | | 8/1997 | Reinhardt |
| 5,680,459 | A | | 10/1997 | Hook et al. |
| 5,682,143 | A | | 10/1997 | Brady et al. |
| 5,720,345 | A | | 2/1998 | Price et al. |
| 5,829,538 | A | | 11/1998 | Wesson et al. |
| 5,911,277 | A | | 6/1999 | Hromas et al. |
| 6,018,501 | A | | 1/2000 | Smith et al. |
| 6,025,780 | A | | 2/2000 | Bowers et al. |
| 6,078,259 | A | | 6/2000 | Brady et al. |
| 6,135,206 | A | * | 10/2000 | Gano et al. ..... 166/297 |
| 6,151,961 | A | | 11/2000 | Huber et al. |
| 6,257,338 | B1 | * | 7/2001 | Kilgore ..... 166/387 |
| 6,333,700 | B1 | | 12/2001 | Thomeer et al. |
| 6,343,649 | B1 | | 2/2002 | Beck et al. |
| 2001/0013410 | A1 | | 8/2001 | Beck et al. |
| 2001/0013411 | A1 | | 8/2001 | Beck et al. |
| 2001/0042617 | A1 | | 11/2001 | Beck et al. |
| 2001/0043146 | A1 | | 11/2001 | Beck et al. |
| 2001/0054969 | A1 | | 12/2001 | Thomeer et al. |

* cited by examiner

METHOD AND SYSTEM FOR PERFORMING A CASING CONVEYED PERFORATING PROCESS AND OTHER OPERATIONS IN WELLS

CROSS REFERENCE TO RELATED APPLICATIONS

This application is a continuation-in-part of application Ser. No. 09/300,056 filed Apr. 27, 1999 entitled "Casing Conveyed Perforating Process And Apparatus", and a continuation-in-part of application Ser. No. 09/586,648, filed Jun. 1, 2000, entitled "Method And System For Performing Operations And For Improving Production In Wells".

FIELD OF THE INVENTION

This invention relates to generally to wells used in the production of fluids such as oil and gas. More specifically, this invention relates to a method and system for perforating and performing other operations in wells.

BACKGROUND OF THE INVENTION

Different operations are performed during the drilling and completion of a subterranean well, and also during the production of fluids from subterranean formations via the completed well. For example, different downhole operations are typically performed at some depth within the well, but are controlled at the surface.

A perforating process is one type of downhole operation that is used to perforate a well casing. A conventional perforating process is performed by placing a perforating tool (i.e., perforating gun) in a well casing, along a section of the casing proximate to a geological formation of interest. The perforating tool carries shaped charges that are detonated using a signal transmitted from the surface to the charges. Detonation of the charges creates openings in the casing and concrete around the casing, which are then used to establish fluid communication between the geological formation, and the casing.

Another example of a downhole operation is the setting of packers within the well casing to isolate a particular section of the well or a particular geological formation. In this case, a packer can be placed within the well casing at a desired depth, and then set by a setting tool actuated from the surface. Other exemplary downhole operations include the placement of bridge plugs, and cutting operations.

In the past downhole operations have been controlled by transmission of signals from surface equipment to downhole equipment located in the well. This control method typically requires a signal transmission conduit to provide signal communication between the surface equipment and the downhole equipment. For example, electric lines are used to transmit electronic signals, and hydraulic lines are used to transmit hydraulic signals.

Conventional signal transmission conduits are expensive to install in a well, and must often be discarded after the well is completed. In addition, signal transmission conduits are subject to rough handling, and must operate in harsh conditions such as in corrosive fluids at high temperatures and pressures. Accordingly, signal transmission conduits can be damaged, and problems can occur during signal transmission from the surface equipment to the downhole equipment. It would be desirable to be able to control downhole operations without the necessity of signal transmission conduits to the surface.

The present invention is directed to a method and system for perforating and performing various operations in wells in which signal transmission conduits to the surface are not required.

SUMMARY OF THE INVENTION

In accordance with the present invention a method and a system for performing various operations in wells are provided. The method, broadly stated, includes the steps of providing a process tool configured to perform an operation in a well, and placing the tool at a required depth within the well. For placing the tool at the required depth, the tool can be conveyed on a casing of the well (e.g., casing conveyed), conveyed on a tubing string of the well (e.g., tubing conveyed), or conveyed on an external conveyance mechanism, such as a wire line or a coil tubing placed in the well. In addition, well logs and a logging tool can be used to place the tool in the well at the required depth.

The method also includes the steps of placing a reader device in the well configured to control the tool, and then transporting an identification device through the well past the reader device to actuate the reader device and control the tool. The identification device can comprise a radio identification device configured to receive rf transmission signals from the reader device, and to transmit a unique code signal to the reader device responsive to reception of the transmission signals. The reader device can comprise a transmitter configured to provide the rf transmission signals, and a receiver configured to receive the unique code signal from the identification device.

The identification device includes a programmable memory device, such as a transceiver chip for storing and generating the unique code signal. The identification device can be configured as a passive device, as an active device, or as a passive device which can be placed in an active state by transmission of signals through well fluids. In addition, the identification device can be transported through a casing of the well, or alternately through a tubing string of the well, using a transport mechanism, such as a pump, a robot, a parachute or gravity.

In addition to the transmitter and the receiver, the reader device includes a control circuit configured to generate control signals for controlling the tool responsive to reception of the unique code signal from the identification device. The reader device control circuit includes a controller which comprises one or more memory devices programmable to look for the unique code signal. The reader device control circuit also includes a power source, such as a battery, and a telemetry circuit for transmitting control signals to the tool. The reader device can be mounted to a collar configured to allow rf signals to freely travel between the reader device and the identification device. The collar can be attached to the process tool, to the well casing, or to the tubing string of the well.

In a first embodiment the tool comprises a casing conveyed perforating tool placed at the required depth in the well, and a perforating process is performed as the identification device is transported past the perforating tool, and transmits the unique rf code signal to the reader device. In a second embodiment the tool comprises a tubing conveyed packer setting tool placed at the required depth in the well, and a packer setting process is performed as the identification device is transported past the packer setting tool, and transmits the unique rf code signal to the reader device.

The system includes the process tool and the reader device placed at the required depth within the well. The system also includes the identification device, and the transport mechanism for transporting the identification device through the well casing, or alternately through the tubing string of the well.

DETAILED DESCRIPTION OF THE PREFERRED EMBODIMENT

Figure 1:
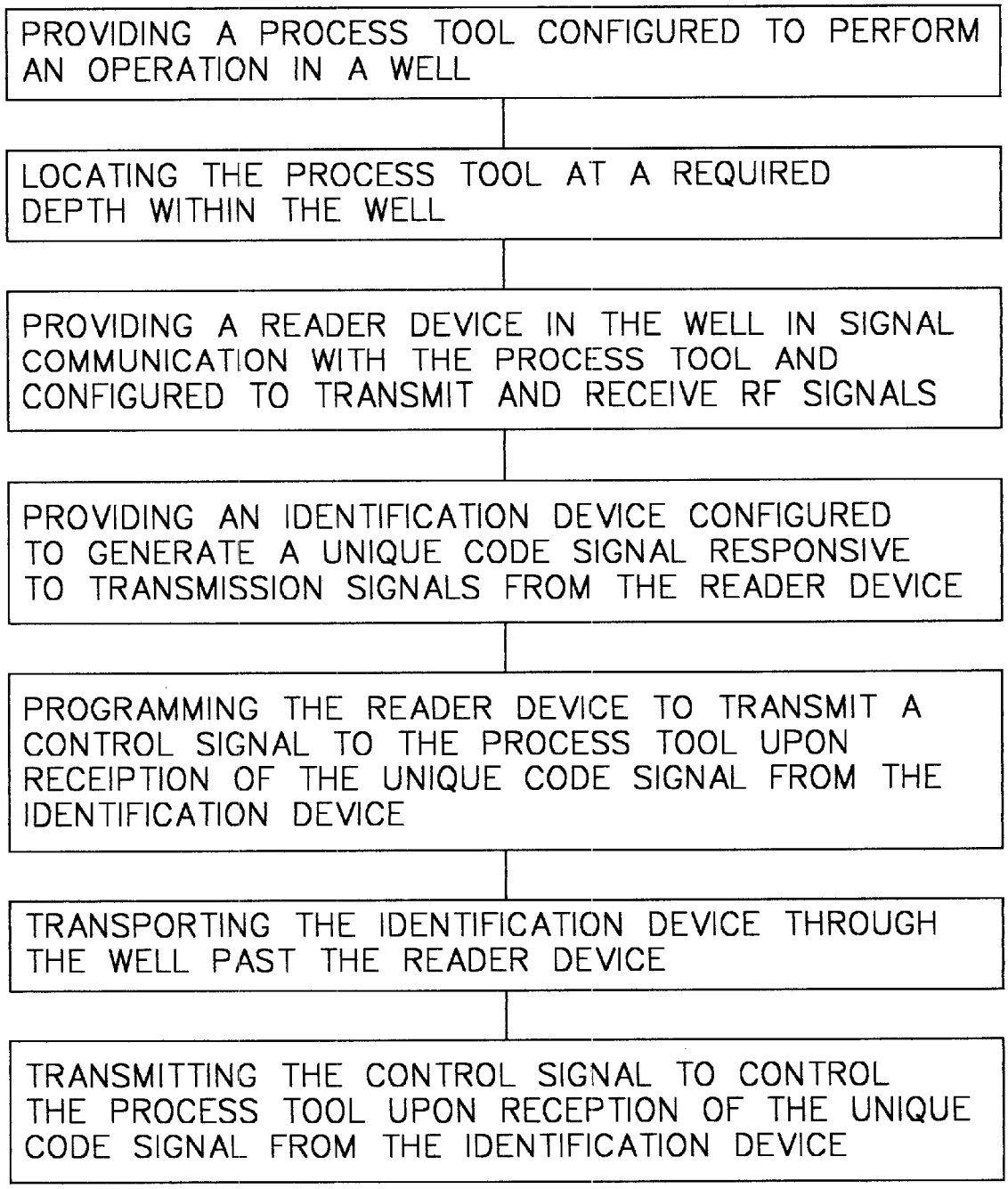
FIG. 1 is a flow diagram illustrating steps in the method of the invention for performing an operation in a well.

Referring to FIG. 1, broad steps in a method for controlling an operation, or a process, in a subterranean well in accordance with the invention, are illustrated. The method, broadly stated, includes the steps of:

A. Providing a process tool configured to perform an operation in the well.

B. Locating the process tool at a required depth within the well.

C. Providing a reader device in the well in signal communication with the process tool and configured to transmit and receive rf signals.

D. Providing an identification device configured to generate a unique code signal responsive to transmission signals from the reader device.

E. Programming the reader device to transmit a control signal to the process tool upon reception of the unique code signal from the identification device.

F. Transporting the identification device through the well past the reader device.

G. Transmitting the control signal to control the process tool upon reception of the unique code signal from the identification device.

Casing Conveyed Perforating System

Figure 2:
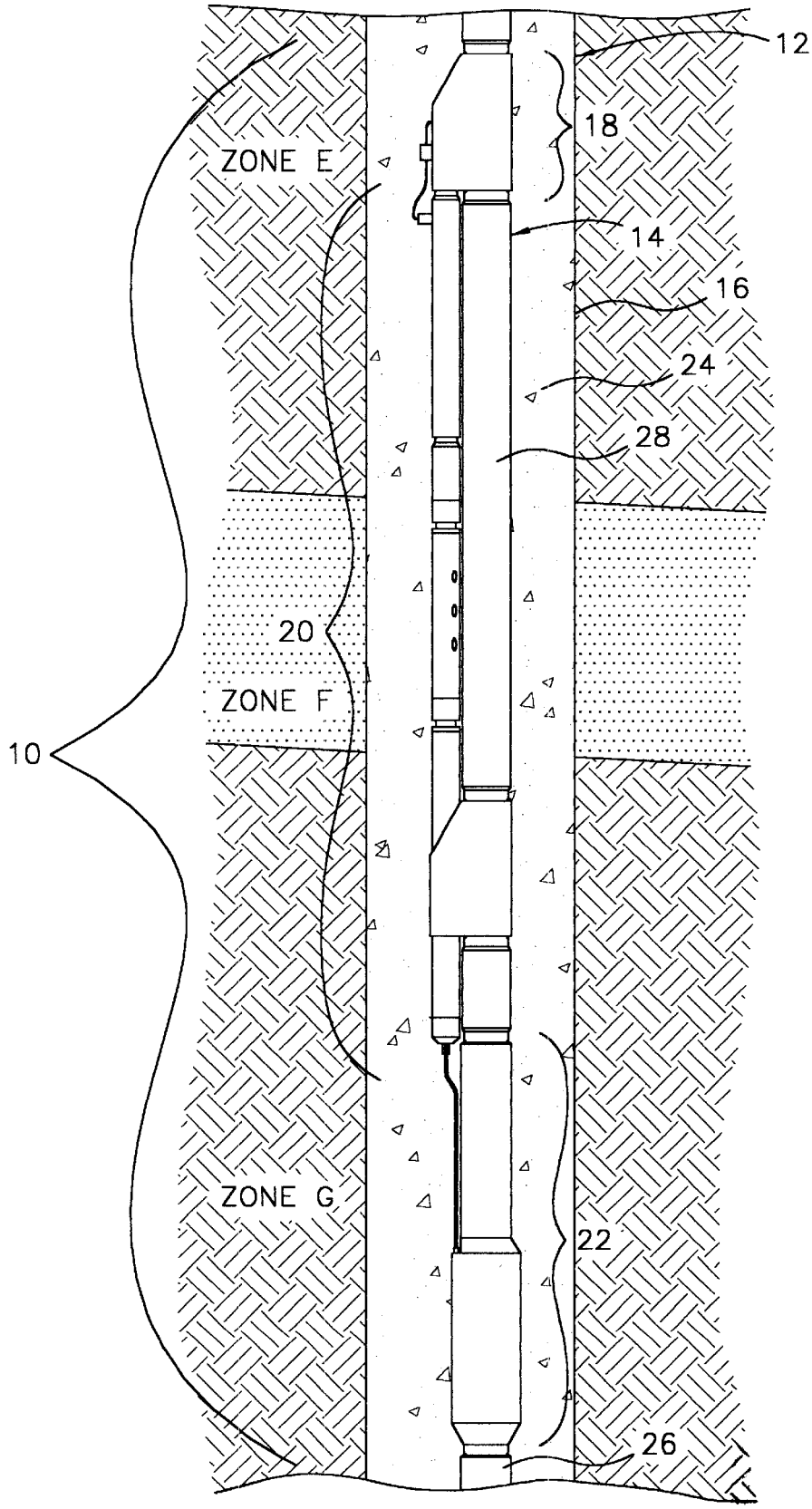
FIG. 2 is a cross sectional view of a well illustrating a casing conveyed perforating system constructed in accordance with the invention.

Referring to FIG. 2, a casing conveyed perforating system 10 constructed in accordance with the invention is illustrated in a subterranean well 12, such as an oil and gas production well. In this embodiment the system 10 is configured to perform a perforating process in the well 12. The perforating process performed in accordance with the invention improves the well 12, and improves production from the well 12.

The well 12 includes a well bore 16, and a well casing 14 within the well bore 16 surrounded by concrete 24. The well 12 extends from an earthen surface (not shown) through geological formations within the earth, which are represented as Zones E, F and G. The earthen surface can be the ground, or alternately a structure, such as an oil platform located above water. In the illustrative embodiment, the well 12 extends generally vertically from the surface through geological Zones E, F, and G. However, it is to be understood that the method can also be practiced on inclined wells, and on horizontal wells.

The well casing 14 comprises a plurality of tubular elements 28, such as lengths of metal pipe or tubing, attached to one another by collars 26 to form a fluid tight conduit for transmitting fluids. The well casing 14 includes an inside diameter adapted to transmit the fluids into, or out of, the well 12, and an outside diameter surrounded by the concrete 24. The collars 26 can comprise couplings having female threads adapted for mating engagement with male threads on the tubular elements 28. Alternately, the collars 26 can comprise weldable couplings adapted for welding to the tubular elements 28.

The well casing 14 can be constructed using techniques that are known in the art. For example, the well bore 16 can initially be formed using a conventional drilling apparatus, and then logged "open hole" using conventional logging techniques. Next, the well casing 14 with the system 10 attached thereto, can be formed in the well bore 16 with the system 10 located at a required depth in the well (e.g., proximate to geological Zones E, F and G). Preferably, the system 10 is attached to the tubular elements 28 of the well casing 14 at the surface, and then lowered into the well bore 16 to the required depth. The system 10 can be located at the required depth using equipment and techniques that are known in the art. For example, as the well casing 14, with the system 10 attached thereto, is lowered into the well bore 16, a log may be obtained by extending a logging tool, such as a gamma ray tool, through the well casing 14 to align the system 10 with the geological zone, or zones, of interest. Alternately, the logging tool can be attached to the well casing 14 proximate to the system 10 to obtain real time logs as the system 10 is lowered into the well bore 16. These logs can then be correlated to the open hole logs to accurately position the system 10 at the required depth. Once the well casing 14 has been formed in the well bore 16, with the system 10 at the required depth, liquid concrete can be pumped through the well casing 14 and into the annular area between the well casing 14 and the well bore 16. The liquid concrete can then be cured to form the concrete 24 around the well casing 14 and the system 10.

In the illustrative embodiment the casing 14 is illustrated as having the same outside diameter and inside diameter throughout its length. However, it is to be understood that the casing 14 can vary in size at different depths in the well 12, as would occur by assembling tubulars with different diameters. For example, the casing 14 can comprise a telescoping structure in which the size thereof decreases with increasing depth.

Figure 2A:
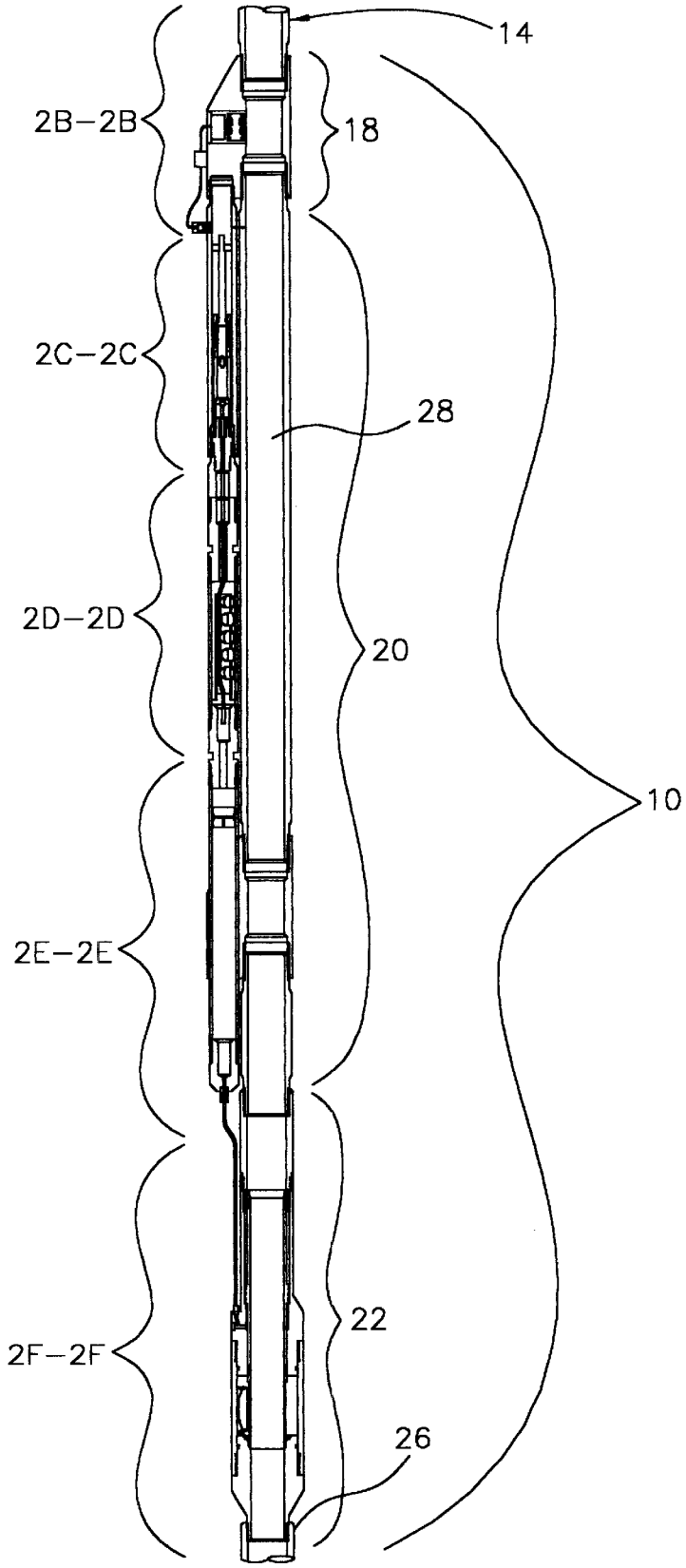
FIG. 2A is a cross sectional view of the system of FIG. 2.

Referring to FIG. 2A, the system 10 is shown in cross section outside of the well 12. The system 10 broadly stated, includes a reader device assembly 18 on the well casing 14; a perforating tool assembly 20 on the well casing 14; and a flapper valve assembly 22 on the well casing 14. The reader device assembly 18 is shown separately in FIG. 2B, the perforating tool assembly 20 is shown separately in FIGS. 2C–2E, and the flapper valve assembly 20 is shown separately in FIG. 2F.

Figure 2B:
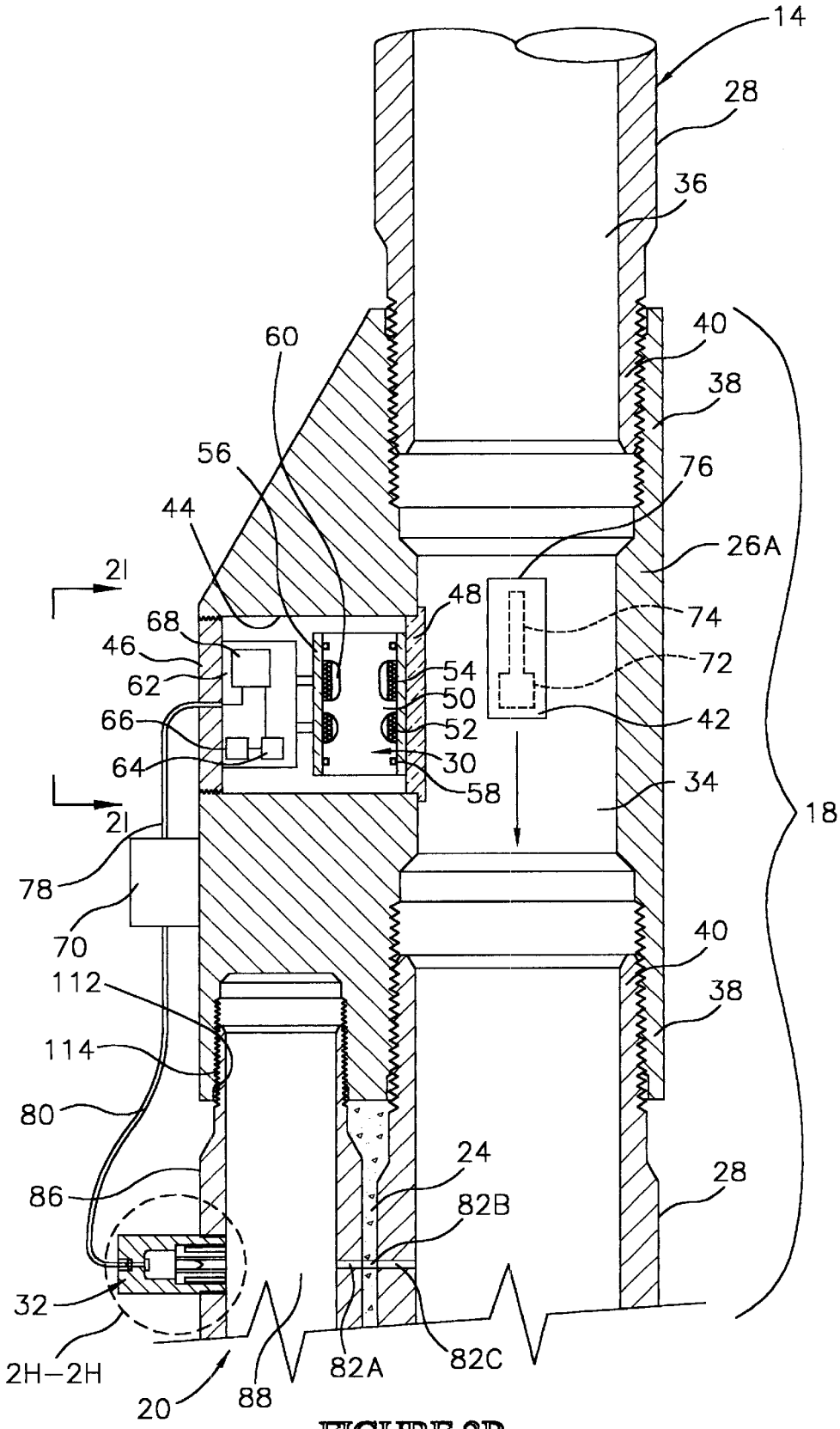
FIG. 2B is an enlarged cross sectional view taken along segment 2B—2B of FIG. 2A illustrating a reader device assembly of the system.

Referring to FIG. 2B, the reader device assembly 18 is shown. The reader device assembly 18, broadly stated, includes a reader device collar 26A attached to the well casing 14; a reader device 30 configured to read signals from an identification device 42 transported through the well casing 14; and a perforating gun 32 configured to perforate the well casing 14 to actuate the perforating tool assembly 20.

The reader device collar 26A comprises a specialty y-block casing collar that is attached to tubular elements 28 of the well casing 14. An inside diameter 34 of the reader device collar 26A is in fluid communication with an inside diameter 36 of the well casing 14. The reader device collar 26A includes female tool joints 38 threadably attached to male tool joints 40 on the tubular elements 28 of the well casing 14. The reader device collar 26A also includes a cylindrical opening 44 wherein the reader device 30 is mounted. A threaded plug 46 seals the opening 44, and the reader device 30 within the opening 44. FIG. 21 illustrates the circular peripheral configurations of the opening 44 and the plug 46.

The reader device collar 26A also includes a window 48 in the opening 44 that seals the opening 44 from the inside diameter 36 of the well casing 14. The window 48 can comprise an electrically non-conductive material, such as plastic or a composite material, that allows rf signals to be freely transmitted between the reader device 30 and the identification device 42. The window 48 has a flanged configuration, and can be attached to the opening 44 in the reader device collar 26A using an adhesive or other fastening mechanism.

The reader device 30 is mounted within the opening 44 in the reader device collar 26A and is sealed by the threaded plug 46 and the window 48. The reader device 30 is configured to transmit RF transmission signals at a selected frequency to the identification device 42, and to receive RF response signals from the identification device 42.

The identification device 42 comprises a passive radio identification device (PRID). PRIDs and associated reader devices are commercially available, and are widely used in applications, such as to identify merchandise in retail stores, and books in libraries. The PRIDs include a circuit which is configured to resonate upon reception of radio frequency energy from a radio transmission of appropriate frequency and strength. Passive PRIDs do not require a power source, as the energy received from the transmission signal provides the power for the PRIDs to transmit a reply signal during reception of the transmission signal. Alternately, the identification device 42 can comprise an active powered device, or a passive device that becomes active upon contact with a conductive medium such as a well fluid.

The reader device 30 includes a base member 50 having a transmitter 52 configured to transmit transmission signals of a first frequency to the identification device 42, and a receiver 54 configured to receive signals of a second frequency from the identification device 42. Preferably, the transmitter 52 is configured to provide relatively weak transmission signals such that the identification device 42 must be within a close proximity (e.g., one foot) of the reader device 30 to receive the transmission signals. Alternately, the transmitter 52 can be configured to provide highly directional transmission signals such that the transmission signals radiate essentially horizontally from the reader device 30. Accordingly, the transmission signals from the reader device 30 are only received by the identification device 42 as it passes in close proximity to the reader device 30.

In addition to the transmitter 52 and the receiver 54, the reader device 30 includes a cover 56 made of an electrically non-conductive material, such as plastic or fiberglass. The reader device 30 also includes o-rings 58 on the base member 50 for sealing the cover 56. In addition, the reader device 30 includes spacer elements 60 formed of an electrically non-conductive material such as ferrite, ceramic or plastic, which separate the transmitter 52 and the receiver 54 from the base member 50. In the illustrative embodiment, the base member 50 is generally cylindrical in shape, and the spacer elements 60 comprise donuts with a half moon or contoured cross sections.

The reader device 30 also includes a control circuit 62 in signal communication with the transmitter 52 and the receiver 54. The control circuit 62 includes a battery 66 and a controller 64, such as one or more integrated circuit chips, configured to receive and store programming information. The control circuit 62 also includes a telemetry circuit 68 configured to transmit control signals to an electric detonator 70 in signal communication with the perforating gun 32. Electric line 78 transmits signals between the control circuit 62 and the electric detonator 70. Electric line 80 transmits signals between the electric detonator 70 and the perforating gun 32.

Still referring to FIG. 2B, the identification device 42 includes a base member 76 and a memory device 72. The memory device 72 can comprise a programmable integrated circuit chip, such as a transceiver chip, configured to receive and store identification information. In addition, the memory device 72 is configured to generate a unique rf code signal in response to receiving rf transmission signals from the reader device 30.

The identification device 42 also includes an antenna 74 for receiving the rf transmission signals from the reader device 30 and for transmitting the unique rf code signal to the reader device 30. The base member 76 can have any geometrical configuration (e.g., flat rectangular, hollow cylindrical) which is suitable for mounting the memory device 72 and the antenna 74. In addition, the base member 76 can be configured to protect the memory device 72 and the antenna 74 in the harsh environment encountered in the well 12. For example, the memory device 72 and the antenna 74 can be sealed on the base member 76 using a suitable process such as a plastic molding or encapsulation process.

Further details of the reader device 30 and the identification device 42 are disclosed in U.S. application Ser. No. 09/586,648, filed Jun. 1, 2000, entitled "Method And System For Performing Operations And For Improving Production In Wells", and in U.S. application Ser. No. 09/286,650, filed Apr. 6, 1999, entitled "Method And Apparatus For Determining Position In A Pipe", both of which are incorporated herein by reference.

Still referring to FIG. 2B, control signals from the reader device control circuit 62 are used to actuate the electric detonator 70. In particular, the reader device 30 is programmed to transmit the control signals to the electric detonator 70 upon reception of the unique code signal from the identification device 42. Upon reception of the control signals from the reader device control circuit 62, the electric detonator 70 initiates a detonation sequence for the perforating gun 32.

The perforating gun 32 is configured to form a first opening 82A through a tubular support element 86 of the perforating tool assembly 20, a second opening 82B through the concrete 24, and a third opening 82C through the well casing 14. The openings 82A, 82B, 82C establish fluid communication between the inside diameter 36 of the well casing 14 and the inside diameter 88 of the tubular support element 86. This fluid communication actuates the perforating tool assembly 20 in a manner which will be more fully explained as the description proceeds.

Figure 2C:
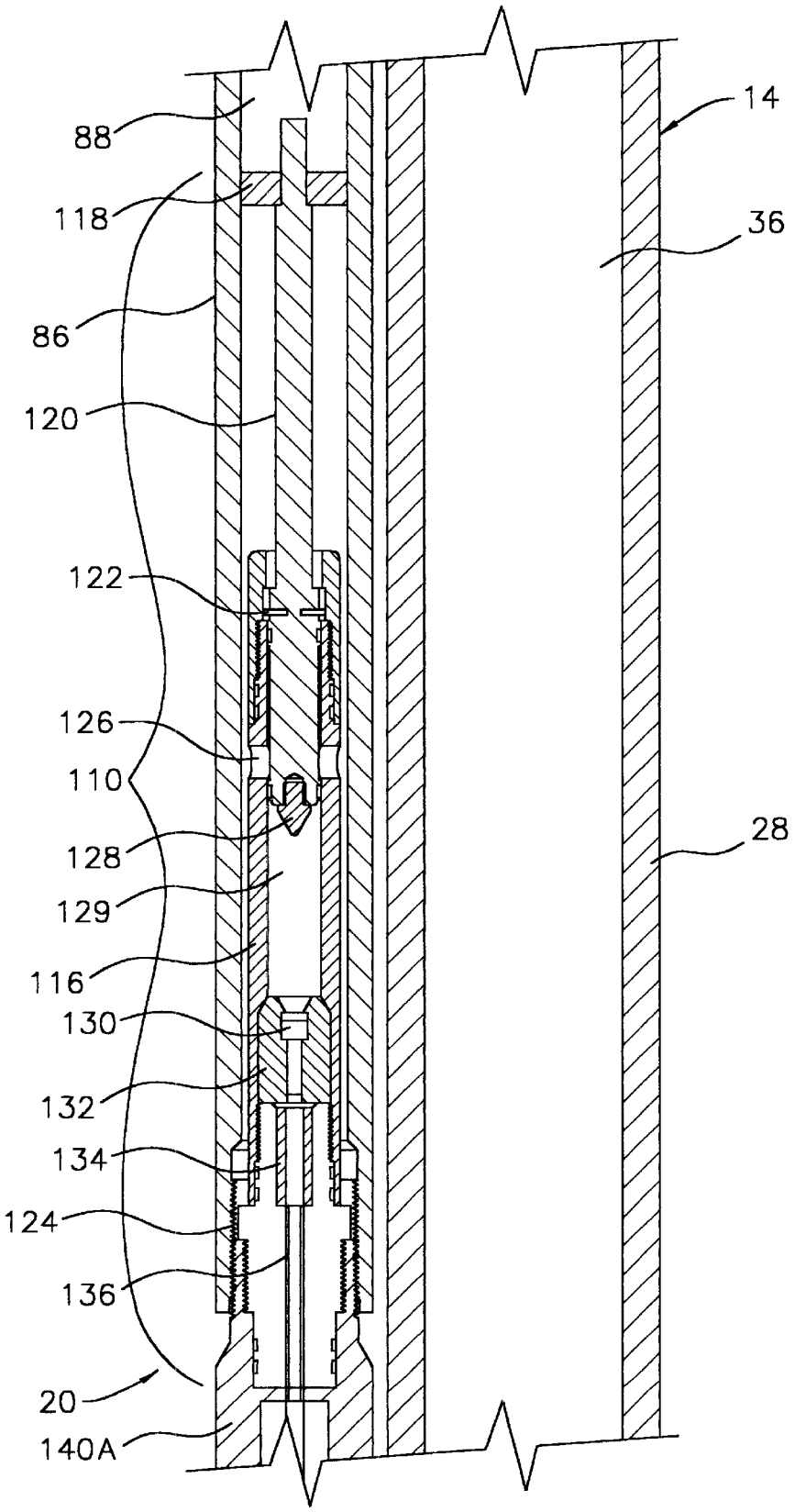
FIG. 2C is an enlarged cross sectional view taken along segment 2C—2C of FIG. 2A illustrating a hydraulic detonator of a perforating tool assembly of the system.
Figure 2D:
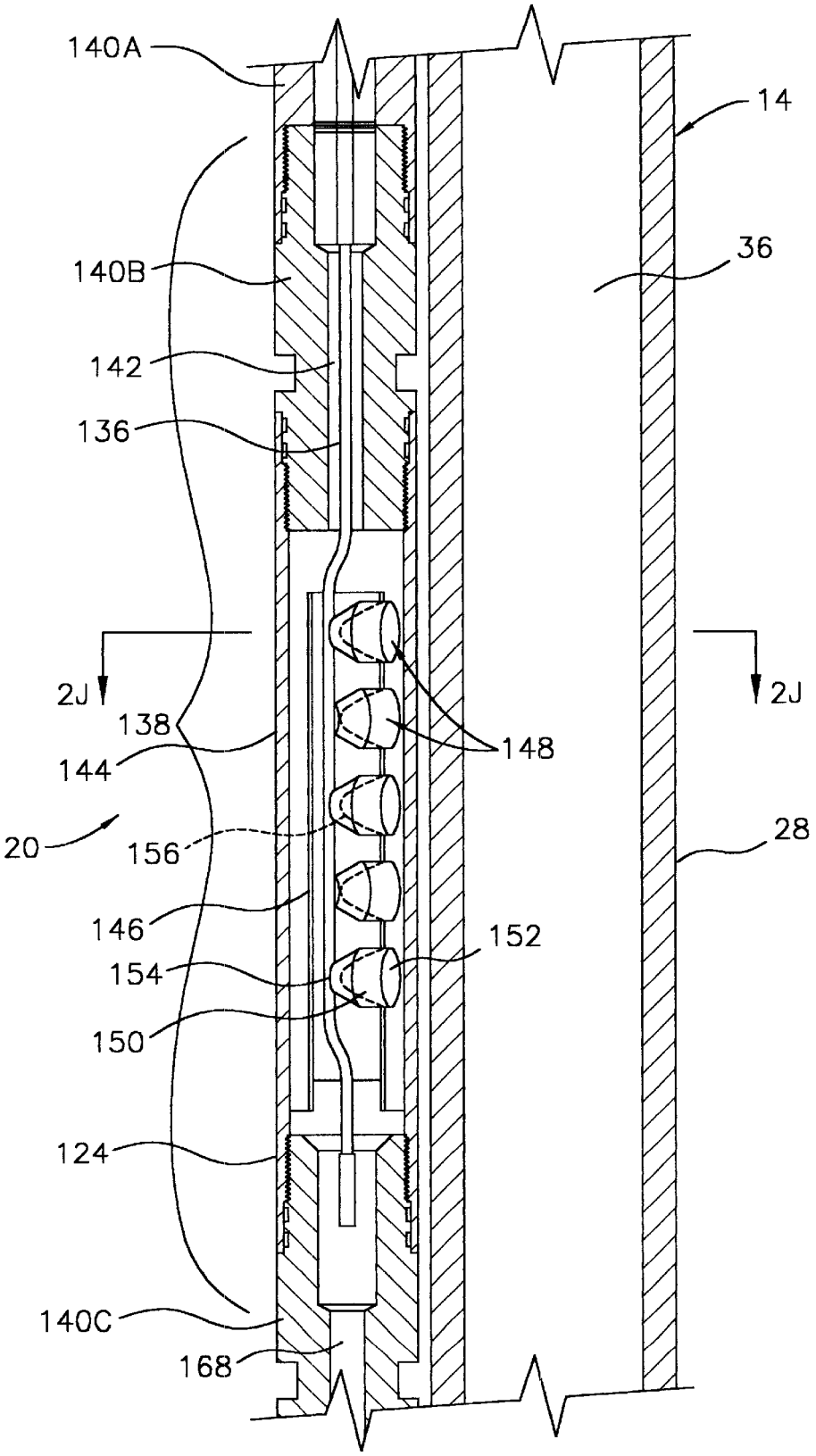
FIG. 2D is an enlarged cross sectional view taken along segment 2D—2D of FIG. 2A illustrating shaped charges of the perforating tool assembly.
Figure 2E:
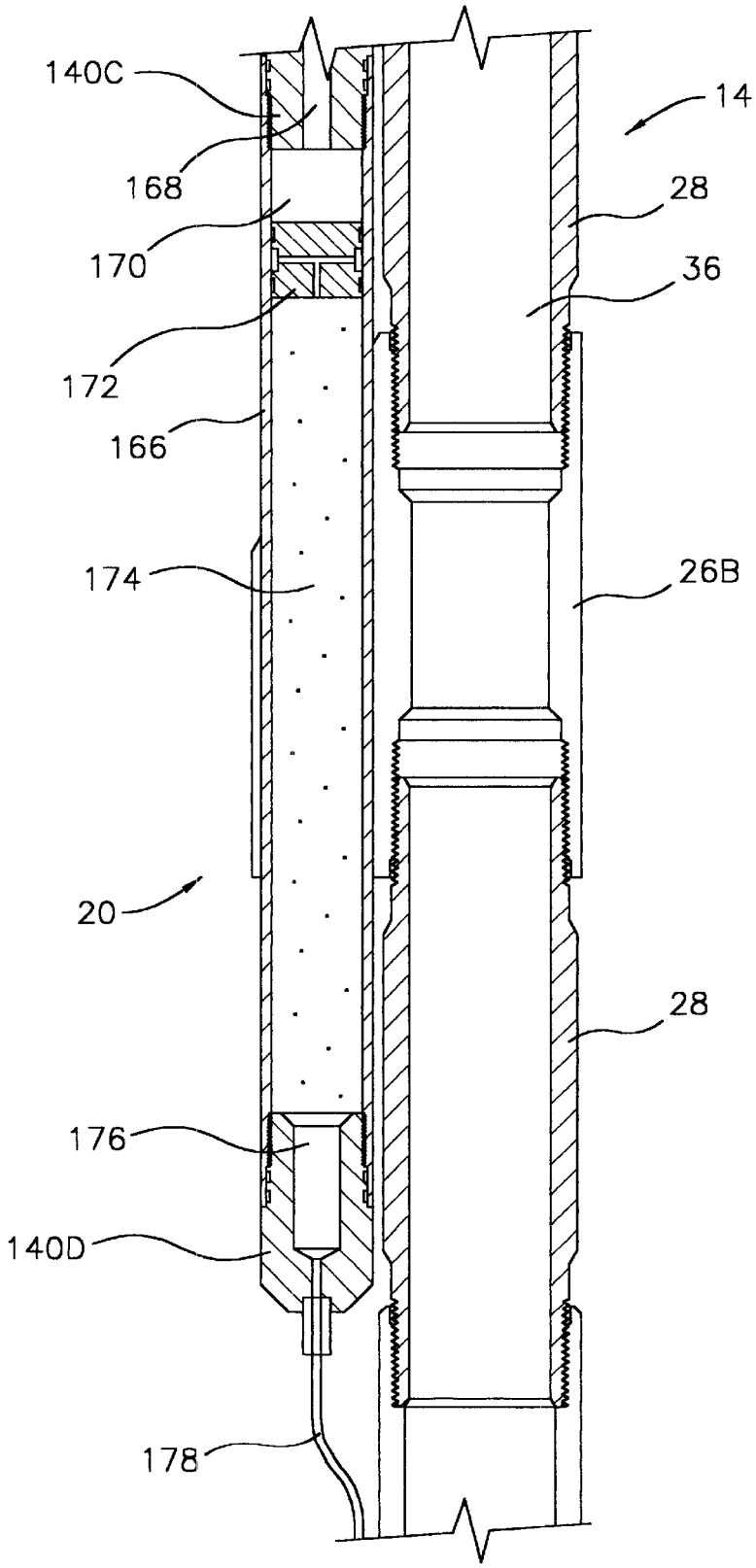
FIG. 2E is an enlarged cross sectional view taken along segment 2E—2E of FIG. 2A illustrating a hydraulic pressure tank of the system.
Figure 2F:
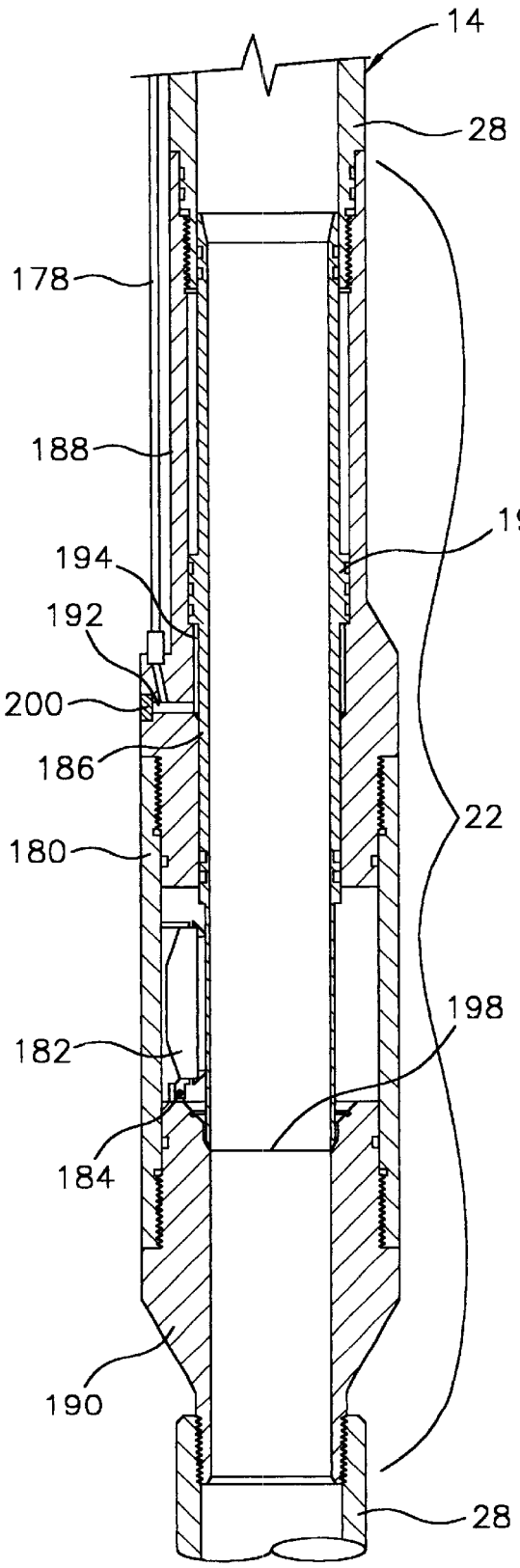
FIG. 2F is an enlarged cross sectional view taken along segment 2F—2F of FIG. 2A illustrating a flapper valve assembly of the system in an open position.
Figure 2G:
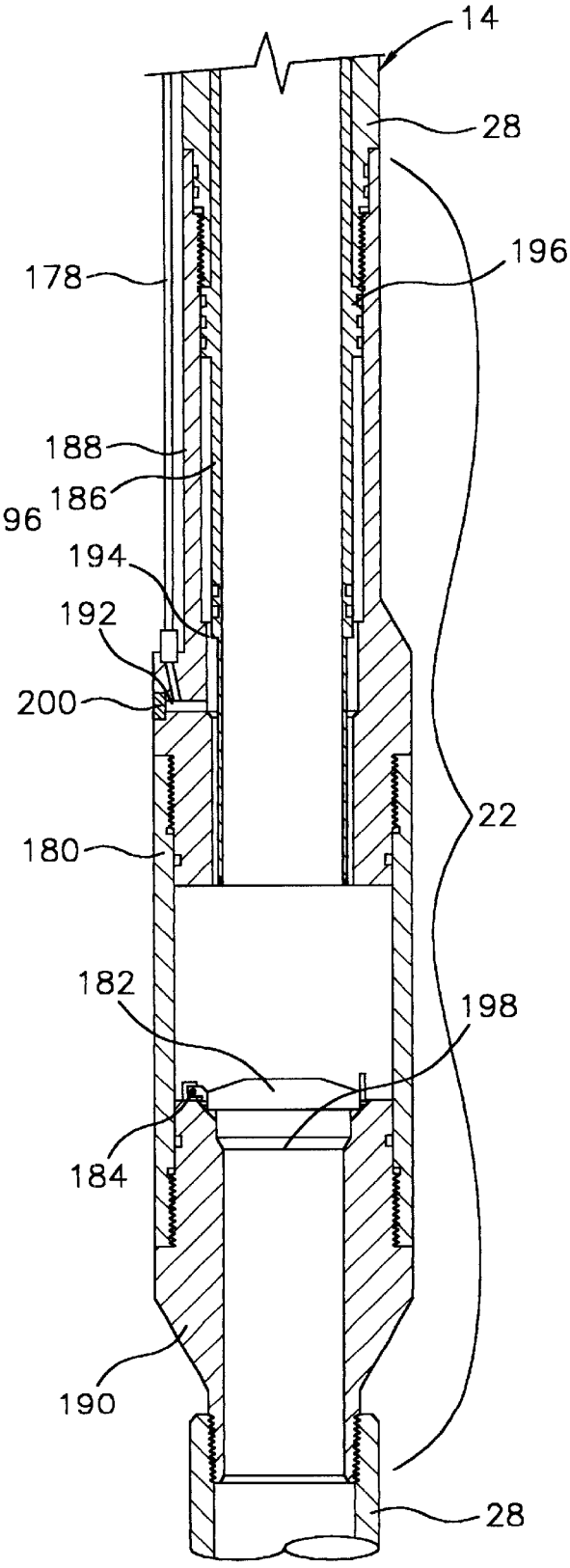
FIG. 2G is an enlarged cross sectional view equivalent to FIG. 2F illustrating the flapper valve in a closed position.
Figure 2H:
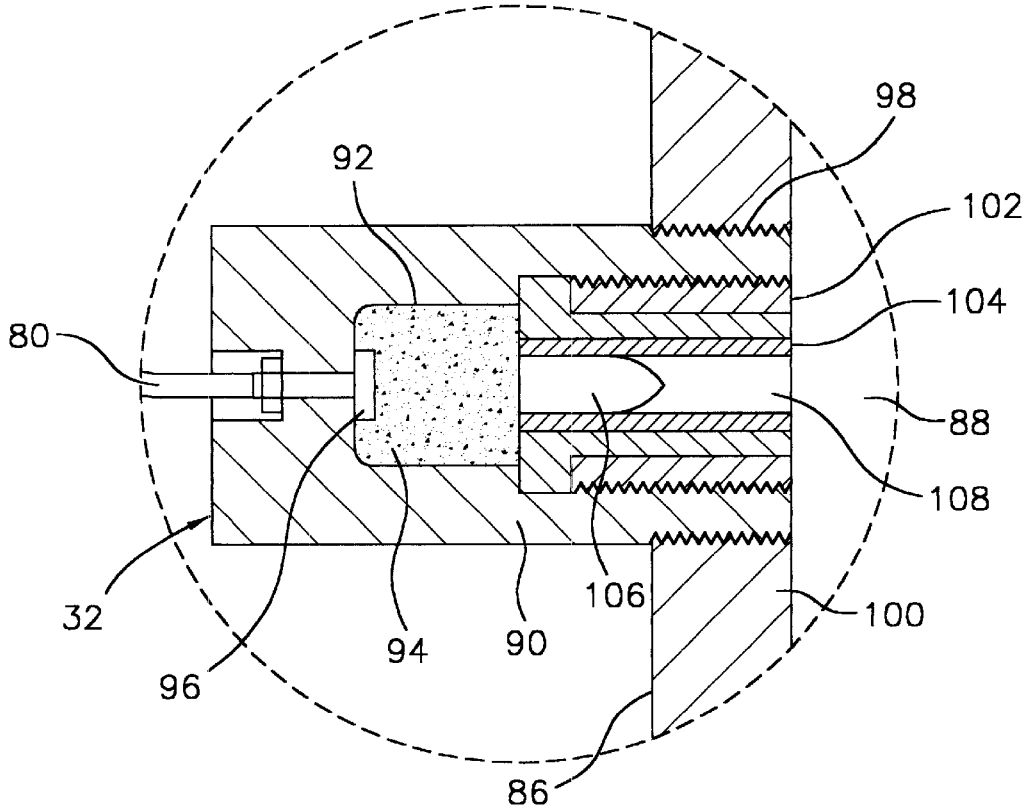
FIG. 2H is an enlarged cross sectional view taken along line 2H—2H of FIG. 2B illustrating a perforating gun of the perforating tool assembly.
Figure 2I:
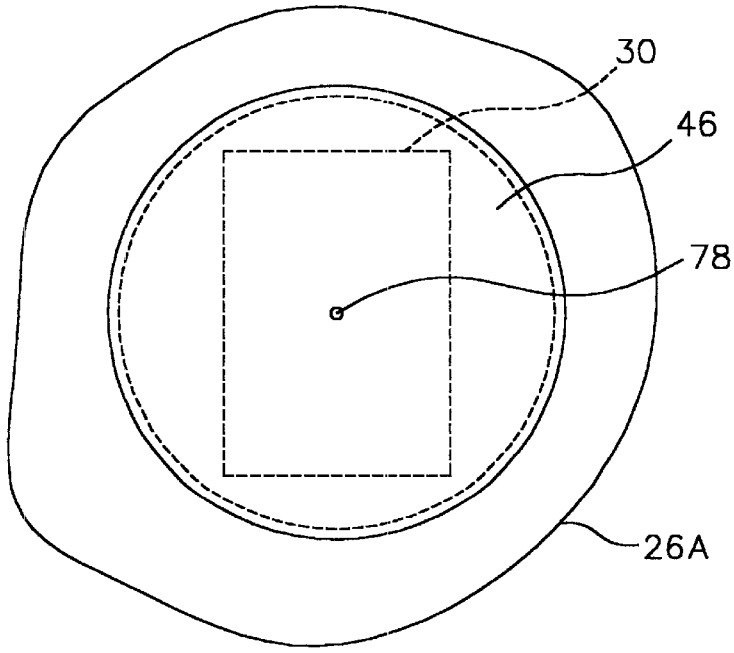
FIG. 2I is an enlarged plan view taken along line 2I—2I of FIG. 2B illustrating a mounting for a reader device of the reader device assembly.

Referring to FIG. 2H, the perforating gun 32 is shown in an enlarged view. In the illustrative embodiment the perforating gun 32 is adapted to fire a projectile 106 to form the openings 82A, 82B, 82C. However, as is apparent to those skilled in the art, the perforating gun 32 can alternately comprise a charge assembly configured to fire a shaped charge rather than a projectile. Such a charge assembly 148 is shown in FIG. 2D and will be hereinafter described. Further, although the perforating gun 32 and electric detonator 70 are illustrated as being mounted outside of the casing collar 26A, these components can be mounted internally in openings in the casing collar 26A.

The perforating gun 32 includes a gun body 90; a cartridge tube 92 containing a quantity of a propellant 94; and an igniter 96. The gun body 90 includes threads 98 that threadably engage corresponding threads in the walls 100 of the support tube 86 for the perforating tool assembly 20. The perforating gun 32 also includes a threaded barrel member 102 threadably attached to the gun body 90; the projectile 106; and a bore 108 in the gun body 90 lined by a wear member 104. The perforating gun 32 is actuated (i.e., fired) by signals from the detonator 70 (FIG. 2B). During a firing sequence the signals actuate the igniter 96 which ignites the propellant 94 and propels the projectile 106 through the bore 108 to form the openings 82A, 82B, 82C (FIG. 2B).

Referring to FIG. 2C, a detonator assembly 110 of the perforating tool assembly 20 is shown in an enlarged cross sectional view. The detonator assembly 110 is mounted within the support tube 86 of the perforating tool assembly 20. The support tube 86 comprises an elongated hollow tubular member having male threads 112 (FIG. 2B) that threadable engage female threads 114 (FIG. 2B) on the reader device collar 26A (FIG. 2B).

The detonator assembly 110 includes a housing 116 fixedly attached to the support tube 86, and a piston 118 slidably mounted to the support tube 86. The piston 118 is movable in a downhole direction by fluid or air pressure transmitted from the surface, through the inside diameter 36 of the well casing 14, and into the inside diameter 88 of the support tube 86. Recall that openings 82A, 82B, 82C (FIG. 2B) establish fluid communication between the inside diameter 36 of the well casing and the inside diameter 88 of support tube 86. Accordingly, firing of the perforating gun 32 (FIG. 2B) forms the openings 82A, 82B, 82C which pressurizes the support tube 86 and moves the piston 118 to actuate the detonator assembly 110 in a manner to be more fully hereinafter described.

The housing 116 of the detonator assembly 110 includes male threads 124 that threadably attach to corresponding female threads on the support tube 86. The housing 116 also includes shear pins 122 and a vent 126. The shear pins 122 are operatively associated with a rod 120 of the piston 118. Specifically, the shear pins 122 are configured to prevent movement of the piston 118 and the rod 120 until a sufficient threshold pressure is generated in the inside diameter 88 of the support tube 86. Upon generation of this threshold pressure the shear pins 122 will shear, allowing the piston 118 and the rod 120 to move in a downhole direction. The vent 126 is configured to facilitate sliding movement of the rod 120 through the housing 116. In addition, a chamber 129 within the housing 116 is initially filled with air at atmospheric pressure such that the piston 118 and the rod 120 can move when the threshold pressure is generated in the support tube 86.

Still referring to FIG. 2C, the detonator assembly 110 also includes a firing pin 128 attached to the rod 120; a firing head 132 attached to the housing 116; and a percussion detonator 130 attached to the firing head 132. In addition, the detonator assembly 110 includes an ignition transfer 134 attached to the firing head 132; and a detonator cord 136 operably associated with the ignition transfer 134. As is apparent to one skilled in the art the impact of the firing pin 128 on the percussion detonator 130 ignites the detonator 130 and transfers energy through the ignition transfer 134 to the detonator cord 136.

Referring to FIG. 2D, a charge carrier assembly 138 of the perforating tool assembly 20 is shown in an enlarged cross sectional view. The charge carrier assembly 138 includes a first sub 140A threadably attached to the support tube 86 (FIG. 2C) of the detonator assembly 110 (FIG. 2C), and a second sub 140B threadably attached to the first sub 140A. The subs 140A, 140B include an internal bore 142 wherein the detonator cord 136 is located.

The charge carrier assembly 138 also includes a charge carrier 144 threadably attached to the second sub 140B, and a third sub 140C threadably attached to the charge carrier 144. The charge carrier 144 includes an internal charge tube 146 and an array of shaped charge assemblies 148 mounted to the charge tube 146. Each charge assembly 148 includes a charge case 150 and a shaped charge 156 within the charge case 150. Each charge case 150 has a generally conical configuration and can comprise a conventional material, such as steel or ceramic, that is machined, molded or otherwise formed in the required shape. Further, each charge case 150 is open at an explosive end 152, and closed at a detonation end 154.

The shaped charges 156 are formed or loaded on the hollow interior portions of the charge cases 150. The shaped charges 156 can comprise any of a variety of explosive compositions that are known in the art. Suitable compositions include commercially available compositions sold under the trade designations HMX, RDX, HNX, PS, HNS, PYX, TNAZ, HNIW and NONA. The shaped charges 156 can be formed with a selected shape, volume, and density using techniques that are known in the art. In general these parameters, along with the composition, can be selected to achieve a desired explosive force. The detonator cord 136 is in physical contact with the detonation ends 154 of the charge cases 150 and terminates on the third sub 140C. The detonator cord 136 is configured to detonate the shaped charges 156 in a manner that is well known in the art.

Figure 2J:
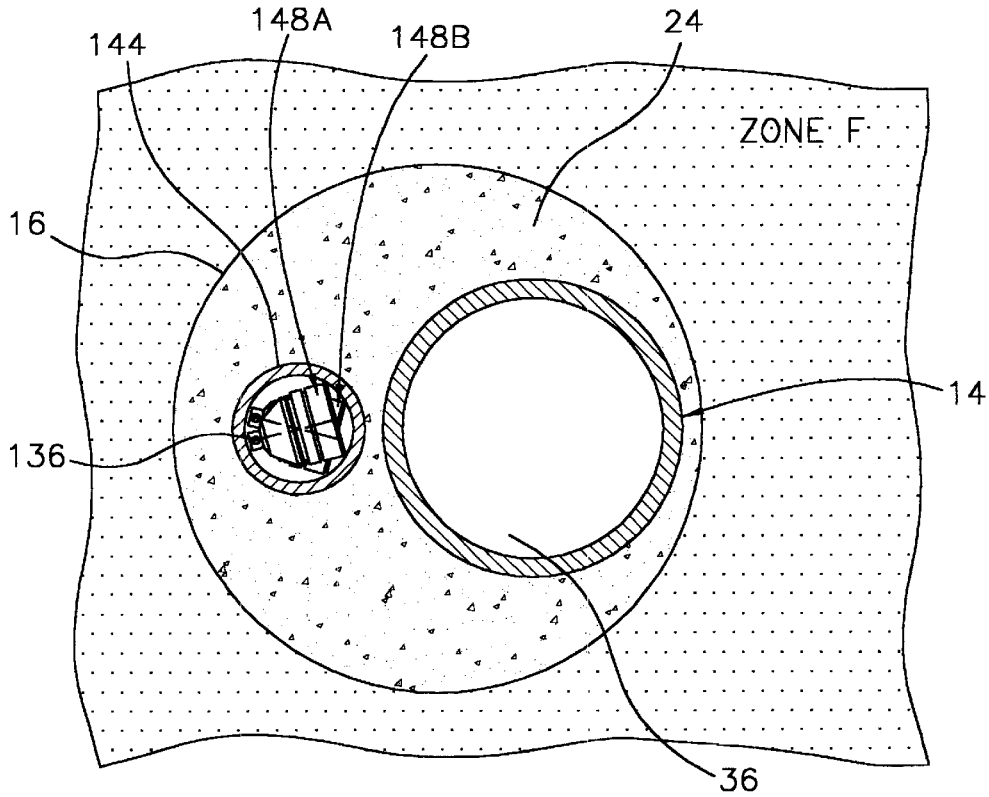
FIG. 2J is an enlarged cross sectional view taken along line 2J—2J of FIG. 2D illustrating a shaped charge of the perforating tool assembly prior to detonation.
Figure 2K:
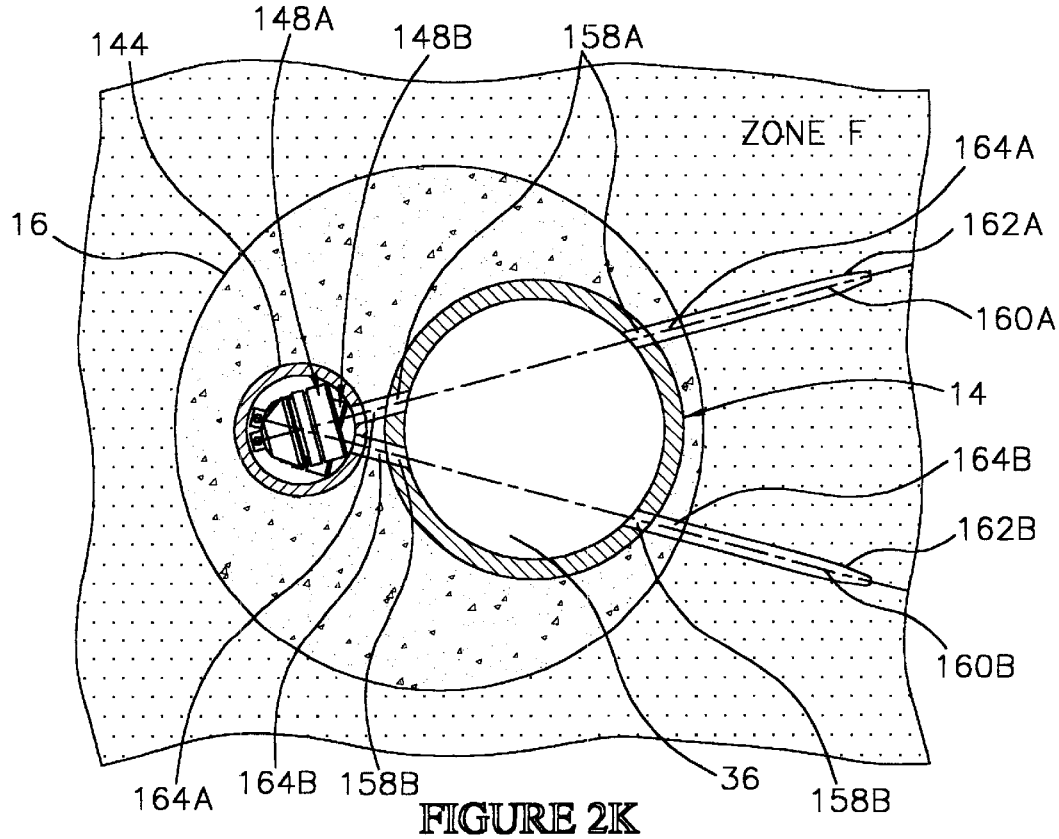
FIG. 2K is an enlarged cross sectional view equivalent to FIG. 2J illustrating the shaped charge following detonation.

FIG. 2J illustrates the well casing 14 prior to detonation of the shaped charges 156 (FIG. 2D) contained within the charge assemblies 148. In FIG. 2J, a first charge assembly is designated 148A, and an adjacent second charge assembly is designated 148B. FIG. 2K illustrates the well casing 14 following detonation of the shaped charges 156 (FIG. 2D) in the charge assemblies 148A, 148B.

As shown in FIG. 2K, detonation of the first charge assembly 148A along explosive path 160A through the well casing 14 forms perforations 158A in the well casing 14, openings 164A in the concrete 24, and fissures 162A in Zone F of the well 12. Detonation of the second charge assembly 148B along explosive path 160B through the well casing 14 forms perforations 158B in the well casing 14, openings 164B in the concrete 24, and fissures 162B in Zone F of the well 12. The fissures 162A, 162B and openings 158A and 158B establish fluid communication between Zone F and the inside diameter 36 of the well casing 14. In addition to perforating the well casing 14, detonation of the charge assemblies 148 creates gases which are channeled into a pressure tank 166 (FIG. 2E) to operate the flapper valve assemblies 22 from an open position (FIG. 2F) to a closed position (FIG. 2G).

Referring to FIG. 2E, the pressure tank 166 is illustrated in an enlarged cross sectional view. The pressure tank 166 comprises an elongated hollow tubular which is threadably connected to the third sub 140C of the charge carrier assembly 138. A pressure tank collar 26B similar to previously described reader device collar 26A also attaches the pressure tank 166 to the well casing 14. In addition, tubular elements 28 of the well casing 14 are threadably attached to the pressure tank collar 26B.

The pressure tank 166 has an inside diameter 170 and a movable piston 172 slidably mounted within the inside diameter 170. The inside diameter 170 is in flow communication with the inside diameter of the charge carrier 144 via bore 168 through the third sub 140C. Gases generated by detonation of the charge assemblies 148 are thus directed through the bore 168 in the third sub 140C and into the inside diameter 170 of the pressure tank 166. The pressure tank 166 also includes a quantity of hydraulic fluid 174 in contact with the piston 172. Gases acting on the piston 172 from detonation of the charge assemblies 148 moves the piston 172 downward to pressurize the hydraulic fluid 174. A fourth sub 140D is attached to the pressure tank 166 and includes a bore 176 in fluid communication with a hydraulic conduit 178. The hydraulic fluid 174 is directed through the hydraulic conduit 178 to the flapper valve assembly 22 (FIG. 2F).

Referring to FIGS. 2F and 2G, the flapper valve assembly 22 is shown in enlarged cross sectional views. In FIG. 2F the flapper valve assembly 22 is shown in an open position. In FIG. 2G the flapper valve assembly is shown in a closed position. The flapper valve assembly 22 is configured to isolate portions of the well casing 14 that are down hole from the perforating tool assembly 20. This permits fluids such as stimulation fluids, such as proppants and acids, and/or treatment fluids, such as scale inhibitors and gelation solutions, to be injected through the inside diameter 36 of the well casing 14, through the perforations 158A, 158B (FIG. 2K) in the well casing 14 and into Zone F (FIG. 2) of the well 12. Further details of the injection of such fluids are disclosed in U.S. application Ser. No. 09/300,056 filed Apr. 27, 1999 entitled "Casing Conveyed Perforating Process And Apparatus", which is incorporated herein by reference.

As shown in FIG. 2F, the flapper valve assembly 22 includes a valve body 180 wherein a flapper valve 182 is hingedly mounted on a torsion spring hinge 184. The flapper valve assembly 22 also includes a sliding sleeve 186 that maintains the flapper valve 182 in the open position of FIG. 2F. In addition, the flapper valve assembly 22 includes a sleeve casing 188 threadably attached to the well casing 14 at an up hole end of the assembly 22, and a valve seat casing 190 threadably attached to the well casing 14 at a downhole end of the assembly 22.

The sleeve casing 188 includes a port 192 in fluid communication with the hydraulic conduit 178. The port 192 is in fluid communication with an annulus 194 between the inside diameter of the sleeve casing 188 and the outside diameter of the sliding sleeve 186. In addition, the port 192 can be sealed from the outside by a test plug 200.

The sliding sleeve 186 includes an enlarged shoulder 196 which is configured for interaction with hydraulic fluid 174 (FIG. 2E) injected into the annulus 194 to move the sliding sleeve 186. Specifically, injection of hydraulic fluid 174 (FIG. 2E) through the hydraulic conduit 178 and the port 192 into the annulus 194, moves the sliding sleeve 186 upward to the position shown in FIG. 2G. This allows the flapper valve 182, under a torque applied by the torsion spring hinge 184, to seat on a seat portion 198 of the valve seat casing 190 to seal the well casing 14. In this manner portions of the well casing 14 above and below the flapper valve 182 are isolated from one another. This permits Zone F of the well 12 to be stimulated and/or treated with fluids injected through the perforations 158A, 158B (FIG. 2K) in the well casing 14 proximate to Zone F. Following fluid stimulation and/or treatment, the flapper valve 182 can be removed using a suitable tool placed through the well casing 14. For example, a coil tubing can be rotated within the well casing 14 to drill out, or ablate, the flapper valve 182.

Figure 2L:
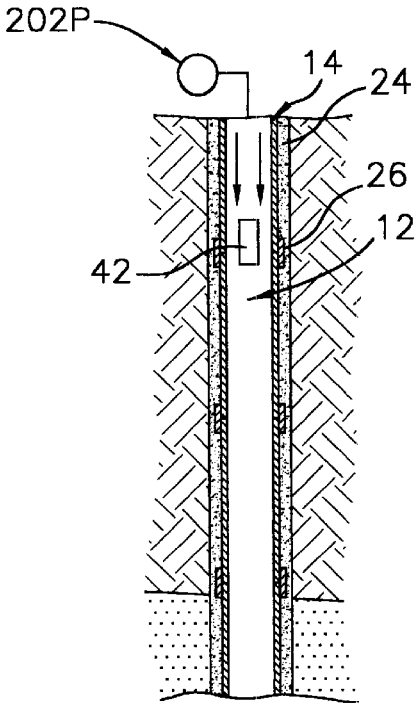
FIGS. 2L–2O are schematic cross sectional views illustrating various transport mechanisms for an identification device of the system.
Figure 2M:
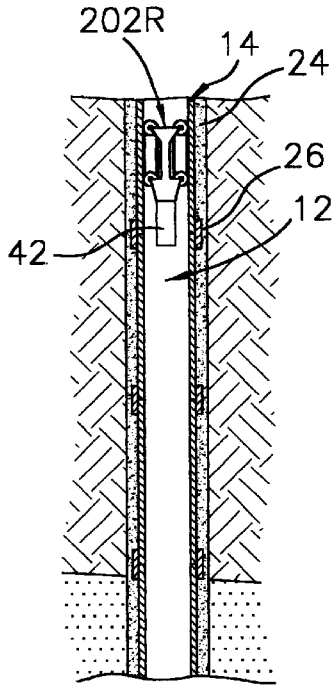
Figure 2N:
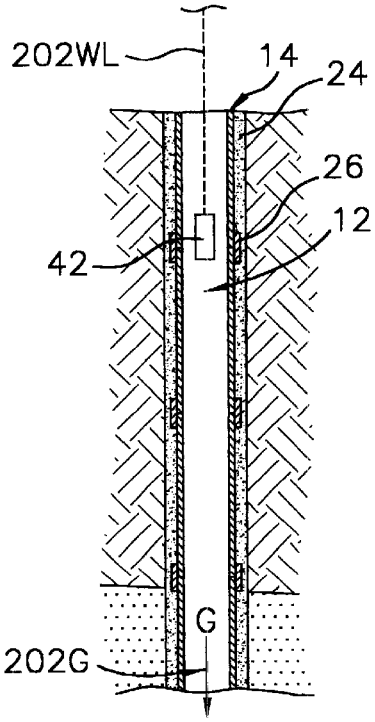
Figure 2O:
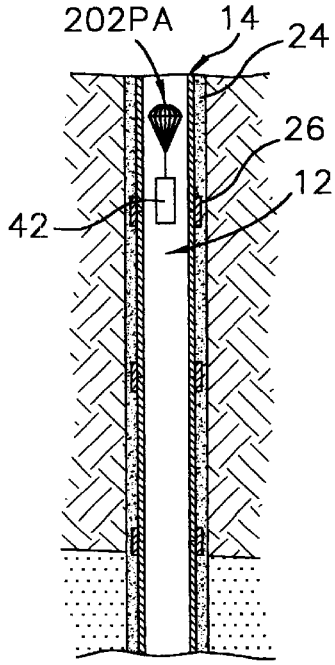

Referring to FIGS. 2L–2O, different transport mechanisms for transporting the identification device 42 through the well casing 14 are illustrated. In FIG. 2L, a transport mechanism 202P comprises a pump for pumping a conveyance fluid through the inside diameter of the casing 14. The pumped conveyance fluid then transports the identification device 42 through the casing 14. In FIG. 2M, a transport mechanism 202R comprises one or more robotic devices attached to the identification device 42, and configured to transport the identification device 42 through the casing 14. In FIG. 2L, a transport mechanism 202G comprises gravity (G) such that the identification device free falls through the casing 14. The free fall can be through a well fluid within the casing 14, or through air in the casing 14. As also shown in FIG. 2N, a transport mechanism 220WL comprises a wire line operated from the surface. In FIG. 2M, a transport mechanism 202PA includes a parachute which controls the rate of descent of the identification device 42 in the casing 14. Again, the parachute can operate in a well fluid, or in air contained in the casing 14.

Casing Conveyed Perforating Process

Figure 3:
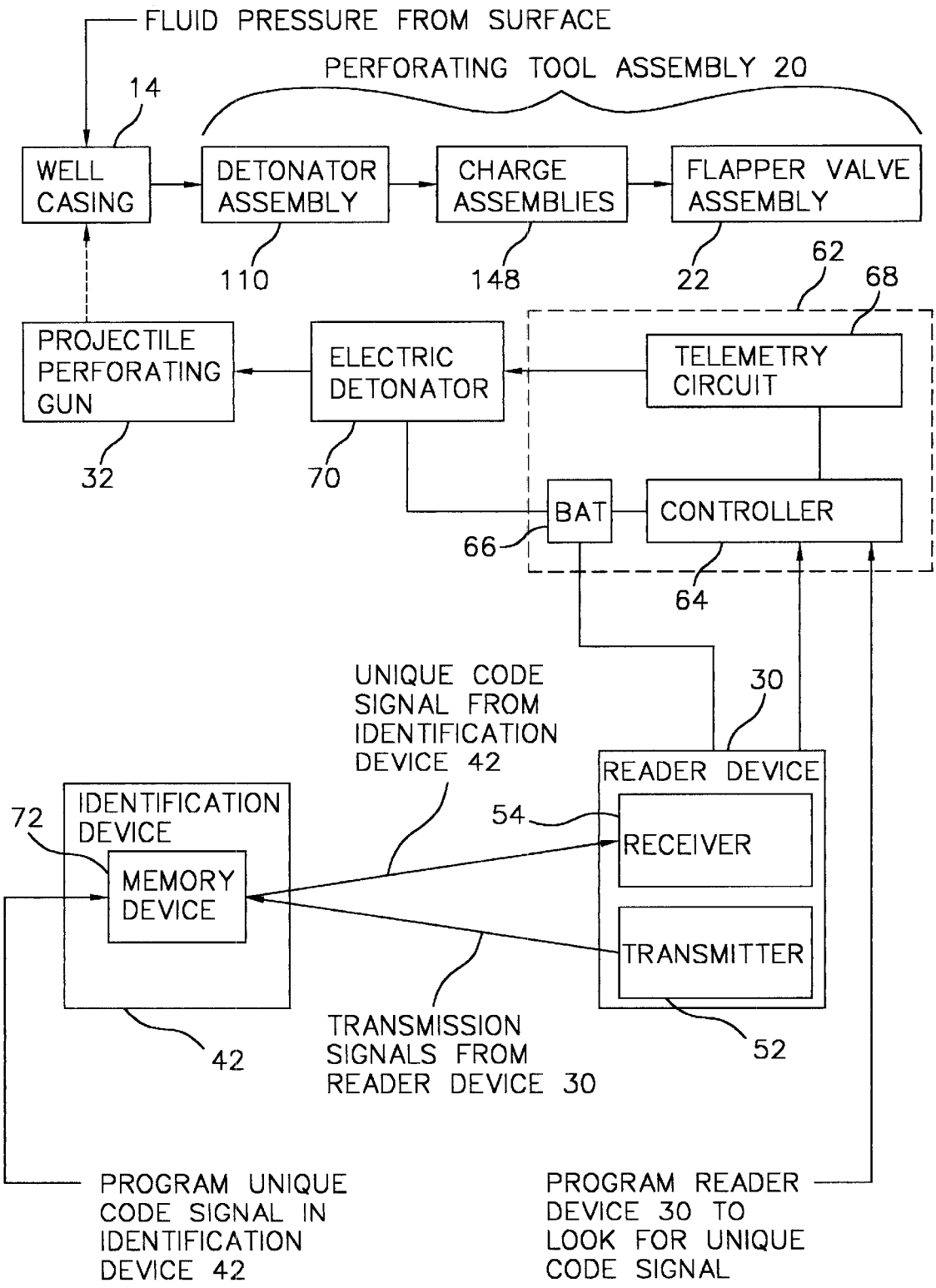
FIG. 3 is a schematic diagram of the system illustrating steps in a casing conveyed perforating method performed in accordance with the invention.

Referring to FIG. 3, a casing conveyed perforating process performed using the system 10 is illustrated in schematic form. To perform the process the well casing 14 (FIG. 2) and the system 10 (FIG. 2) are provided in the well 12 (FIG. 2) with the perforating tool assembly 20 (FIG. 2) located proximate to geological Zone F (FIG. 2).

Initially, the memory device 72 contained in the identification device 42 is programmed to generate the unique code signal. Similarly, the controller 64 in the control circuit 62 for the reader device 30 is programmed to look for the unique code signal. The identification device 42 is then transported through the well casing 14 proximate to the reader device 30. As the identification device 42 passes in close proximity to the reader device 30 transmission signals from the transmitter 52 of the reader device 30 trigger the memory device 72 of the identification device 42 to generate the unique code signal. The unique code signal is transmitted to the receiver 54 of the reader device 30 such that the controller 64 and the telemetry circuit 68 of the reader device 30 generate control signals for actuating the electric detonator 70.

Actuation of the electric detonator 70 fires the perforating gun 32 which perforates the well casing 14 and establishes fluid communication between the well casing 14 and the detonator assembly 110 of the perforating tool assembly 20. Fluid pressure injected from the surface into the well casing 14 actuates the detonator assembly 110, detonating the charge assemblies 148 to perforate the well casing 14. In addition, gas pressure generated by detonation of the charge assemblies 148 places the flapper valve assembly 22 in a closed position to isolate the perforated segment of the well casing. Stimulation and/or treatment fluids can then be injected through the perforated segment into geological Zone F of the well 12.

Sequential Perforating Process

Figure 4:
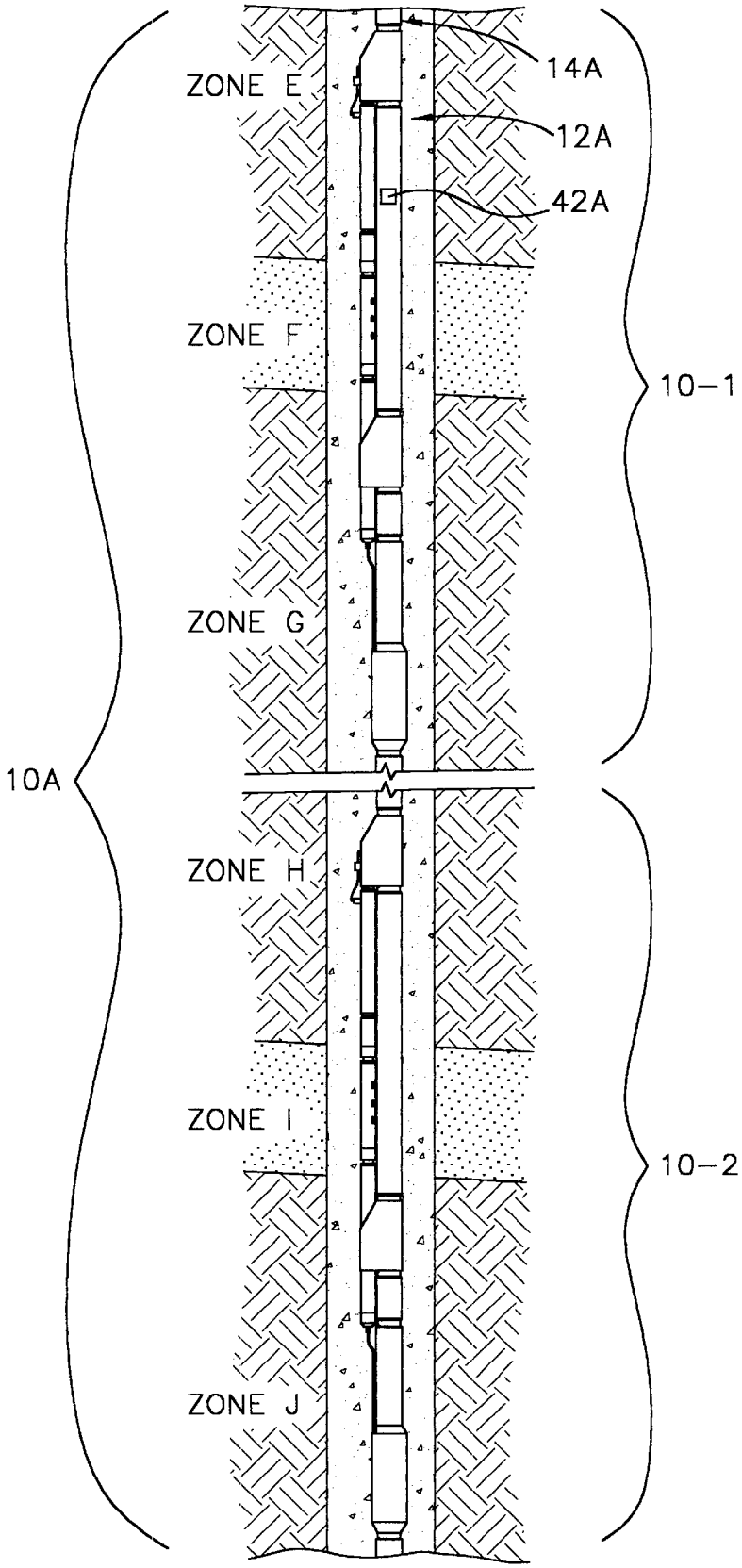
FIG. 4 is a cross sectional view of an alternate embodiment well illustrating a stacked casing conveyed perforating system for perforating multiple zones within the well.

Referring to FIG. 4, an alternate embodiment system 10A configured to perform a sequential perforating process in a well 12A having a casing 14A is illustrated. The system 10A includes two or more casing conveyed perforating systems 10-1 and 10-2 constructed substantially as previously described for perforating system 10 (FIG. 2). In this case it is desired to perforate the well casing 14A proximate to geological Zone F, and to also perforate the well casing 14A proximate to geological Zone I. Accordingly, a single identification device 42A can be transported through the well casing 14A to detonate perforating tool assemblies of the systems 10-1 and 10-2 in sequence. Alternately, a first identification device can be used to detonate the perforating tool assembly of system 10-1 and a second identification device can be used to detonate the perforating tool assembly of system 10-2. With first and second identification devices a desired time interval can be employed between the separate detonation sequences.

Packer Setting Process

Figure 5A:
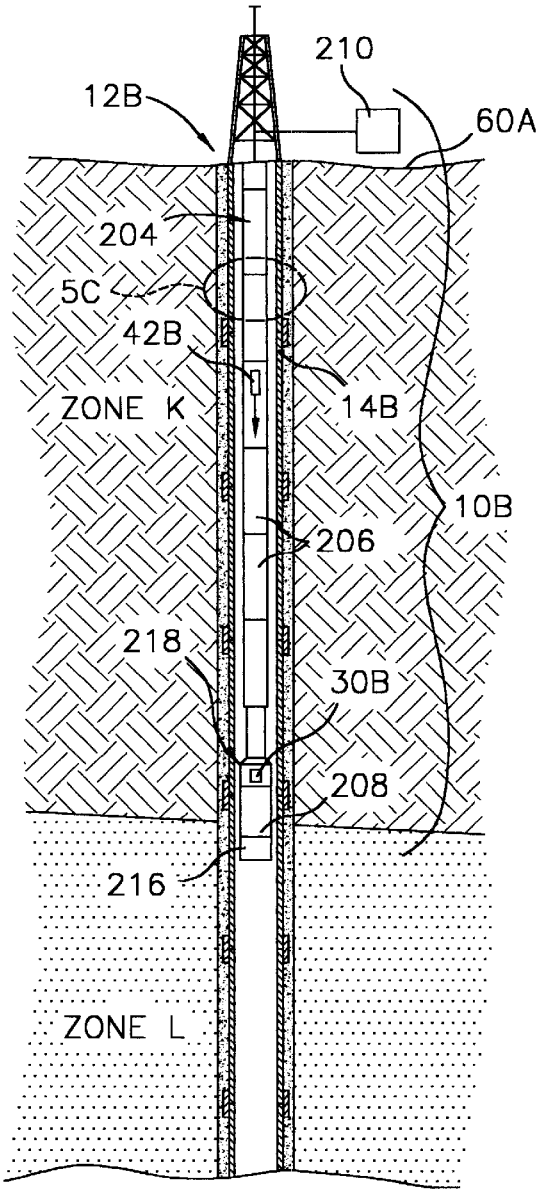
FIGS. 5A and 5B are schematic cross sectional views illustrating an alternate embodiment system constructed in accordance with the invention for performing a packer setting process in a well.
Figure 5B:
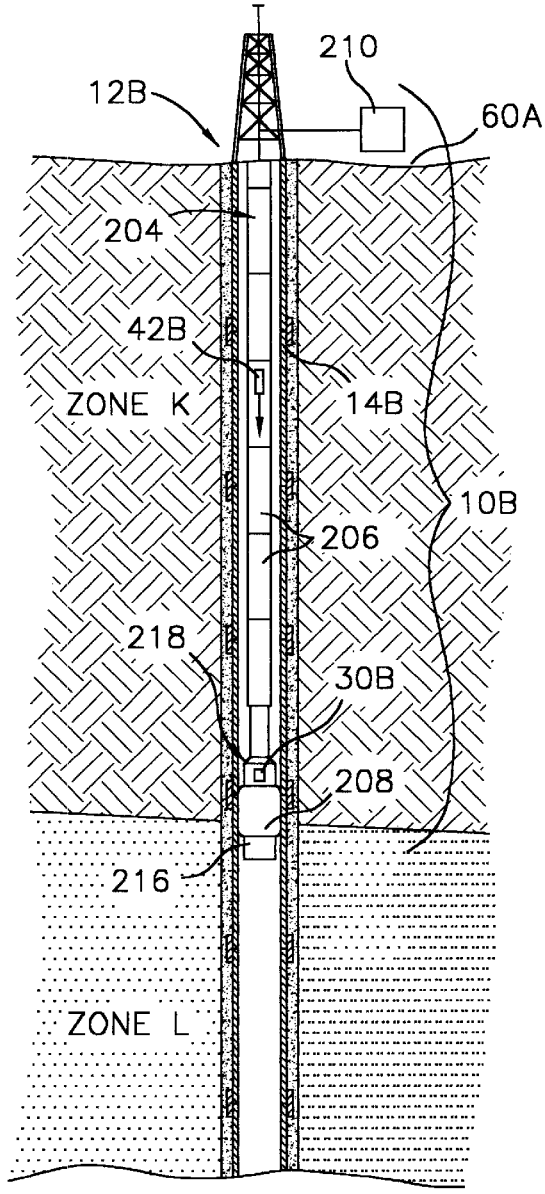
Figure 5C:
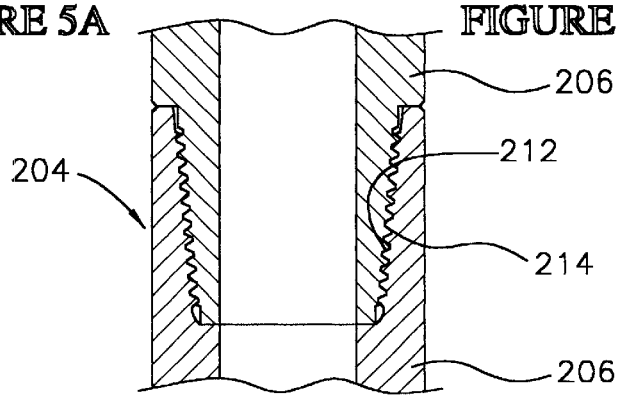
FIG. 5C is an enlarged portion of FIG. 5A taken along line 5C illustrating a threaded connection of a tubing string of the alternate embodiment system.

Referring to FIGS. 5A–5C, an alternate embodiment system 10B configured to perform a packer setting process in a well 12B having a casing 14B is illustrated. The system 10B includes a packer setting tool 218, and a reader device 30B attached to the packer setting tool 218. The packer setting tool 218 includes an inflatable element 208, and an inflation device 210 configured to inflate the inflatable element 208. The inflatable element 208 is configured to sealingly engage the inside diameter of the casing 14B. In FIG. 5A, the inflatable element 208 is shown in an uninflated condition. In FIG. 5B, the inflatable element 208 has been inflated to seal the inside diameter of the casing 14B to isolate geological Zone L.

The system 10B also includes a tubing string 204 configured to place the packer setting tool 218 in the casing 14B proximate to geological Zone L of the well 12B. The tubing string 204 comprises a plurality of tubular elements 206 that have been joined to one another and placed within the well casing 14B. As shown in FIG. 5C, each tubular element 206 includes a male tool joint 214 on one end, and a female tool joint 212 on an opposing end. The packer setting tool 218 also includes a central mandrel 216 in fluid communication with the inside diameter of the casing 14B, and with the inside diameter of the tubing string 204.

In this embodiment, an identification device 42B is transported through the tubing string 204 proximate to the reader device 30B. When the identification device 42B passes the reader device 30B a unique code signal is generated substantially as previously described. Control signals are than transmitted from the reader device 30B to the inflation device 210 to inflate the inflatable element 208 and seal the well casing 14B.

Alternate Embodiment Systems

Figure 6:
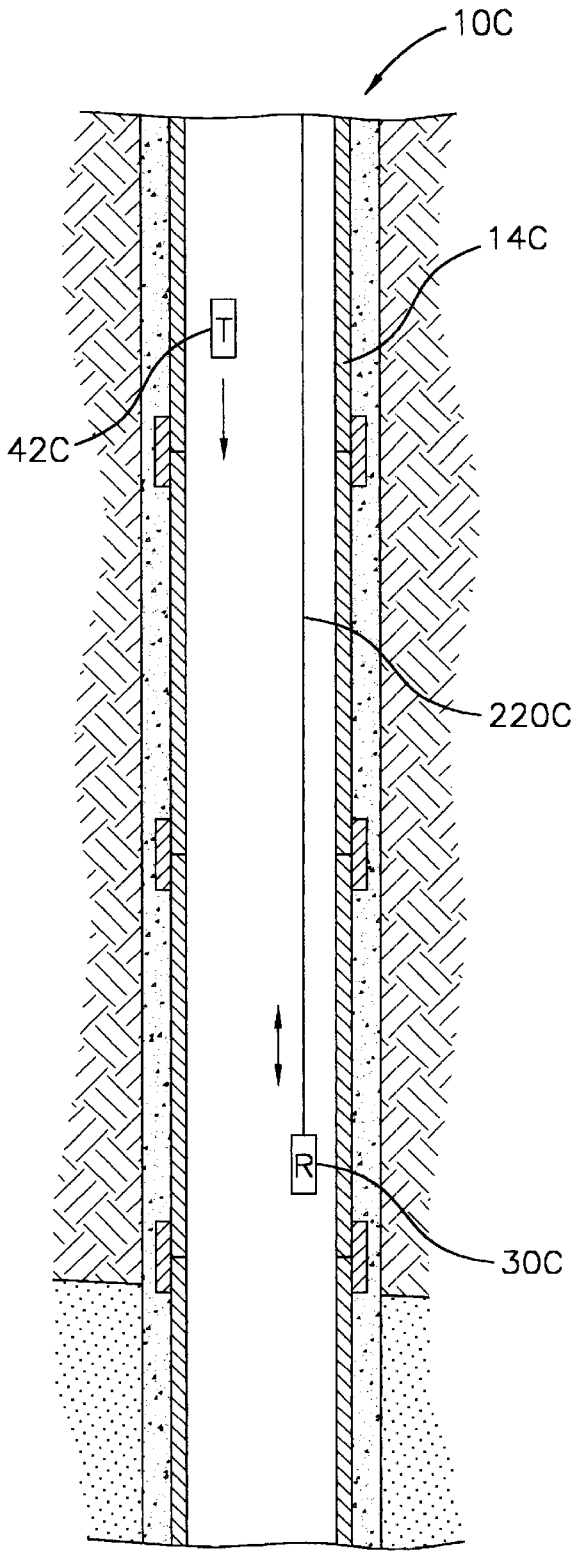
FIG. 6 is a schematic cross sectional view illustrating an alternate embodiment system in which the reader device is suspended in a well on a wire line.

Referring to FIG. 6, an alternate embodiment system 10C includes a reader device 30C suspended from a wire line 220C in a well casing 14C. The wire line 220C can be used to place the reader device 30C at a required depth within the well casing 14C. The system 10C also includes an identification device 42C that is transported through the well casing 14C to control a tool (not shown), or to control a well operation substantially as previously described.

Figure 7:
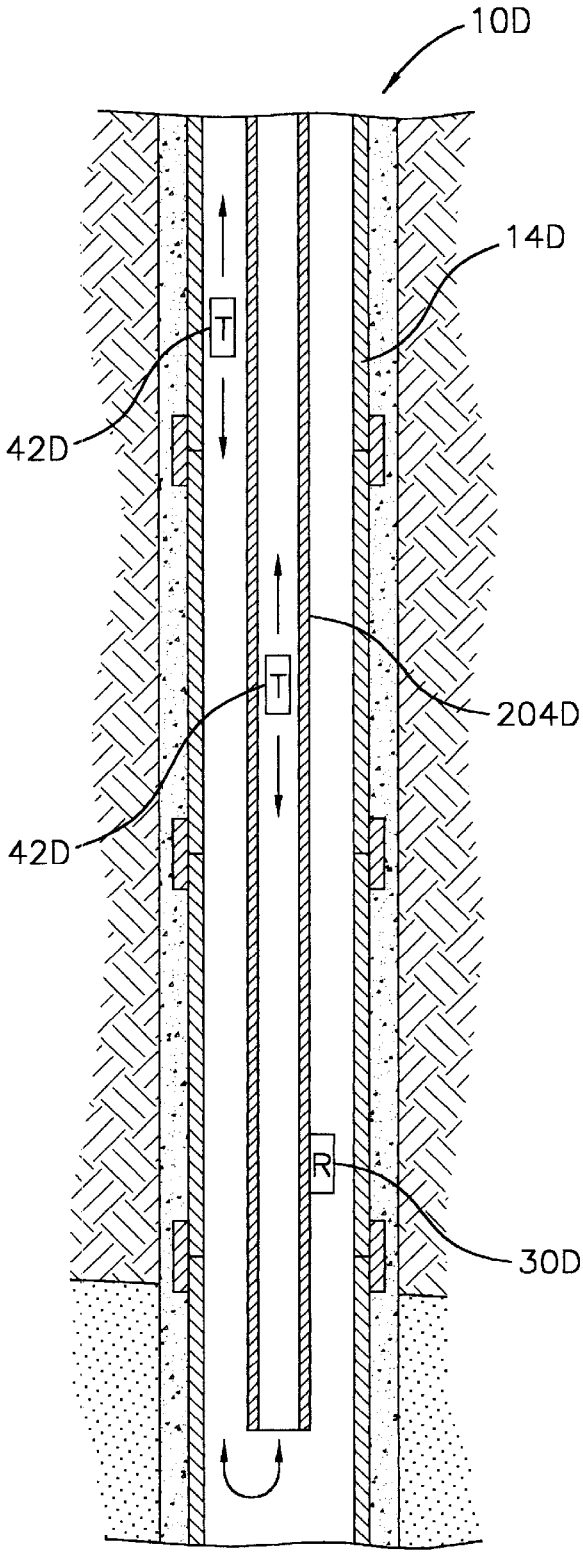
FIG. 7 is a schematic cross sectional view illustrating an alternate embodiment system in which the reader device is attached to a tubing string of a well and multiple identification devices are transported in a circulating well fluid.

Referring to FIG. 7, an alternate embodiment system 10D includes a reader device 30D mounted to a tubing string 204D within a well casing 14D. In addition, one or more identification devices 42D are transported in a well fluid circulating between the tubing string 204D and the well casing 14D. As indicated by the double headed arrows, the path of the circulating well fluid can be down the well casing 14D and up the tubing string 204D, or alternately down the tubing string 204D and up the well casing 14D. In this system 10D the reader device 30D is programmed to look for a predetermined code signal from one or more identification devices 42D to control a tool (not shown), or to control a well operation substantially as previously described.

Thus the invention provides a method and a system for performing a casing conveyed perforating process, and various other operations in wells. While the invention has been described with reference to certain preferred embodiments, as will be apparent to those skilled in the art, certain changes and modifications can be made without departing from the scope of the invention as defined by the following claims.

What is claimed is:

1. A method for performing an operation in a well comprising:

positioning a process tool in the well;

positioning a first device in the well configured to control the process tool, said first device comprising a radio frequency transmitter configured to provide rf signals for reception by a second device and a receiver configured to receive a signal from the second device;

transporting the second device which is configured to transmit a signal to the first device through the well proximate to the first device; and controlling the process tool responsive to the first device receiving the signal from the second device during the transporting step.

2. The method of claim 1 wherein the second device comprises a radio identification device and the signal comprises an rf signal.

3. The method of claim 1 wherein the process tool comprises a perforating tool or a packer setting tool.

4. The method of claim 1 wherein during the transporting step the second device is transported through a casing or through a tubing string of the well.

5. A method for performing an operation in a well comprising:

providing a process tool in a well, said process tool being configured to perform an operation;

providing a first device in the well in signal communication with the process tool and configured to transmit and receive rf signals;

transporting a second device through the well proximate to the first device, said second device configured to generate a unique rf signal responsive to radio frequency signals from the first device; and controlling the process tool responsive to reception of the unique rf signal by the first device during the transporting step.

6. The method of claim 5 wherein the first device comprises a radio frequency reader device.

7. The method of claim 6 wherein the second device comprises a radio frequency identification device.

8. The method of claim 7 wherein the process tool comprises a casing conveyed perforating tool.

9. The method of claim 7 wherein the process tool comprises a tubing conveyed packer setting tool.

10. A method for performing an operation in a well comprising:

locating a process tool at a required depth within a well;

providing a reader device in the well in signal communication with the process tool and configured to transmit and receive rf signals;

providing an identification device configured to generate a unique code signal responsive to transmission signals from the reader device;

programming the reader device to transmit a control signal to the process tool upon reception of the unique code signal from the identification device;

transporting the identification device through the well past the reader device; and transmitting the control signal to control the process tool upon reception of the unique code signal from the identification device.

11. The method of claim 10 wherein the locating step comprises attaching the process tool to a tubular and placing the tubular at the required depth.

12. The method of claim 10 wherein the locating step comprises conveying the process tool to the required depth on a casing of the well.

13. The method of claim 10 wherein the locating step comprises conveying the process tool to the required depth on a tubing string of the well.

14. The method of claim 10 wherein the transporting step is performed by gravity.

15. The method of claim 10 wherein the transporting step is performed by a mechanism selected from the group consisting of a pump, a robot and a parachute.

16. A method for performing an operation in a well comprising:

providing a first process tool at a first depth in the well and a second process tool at a second depth in the well;

providing a first reader device in the well configured to control the first process tool and a second reader device in the well configured to control the second process tool;

transporting a first radio identification device through the well proximate to the first reader device, and a second identification device through the well proximate to the second reader device, the first identification device configured to transmit a first code signal to the first reader device, and the second identification device configured to transmit a second code signal to the second reader device;

controlling the first process tool responsive to the first reader device receiving the first code signal during the transporting step; and controlling the second process tool responsive to the second reader device receiving the second code signal during the transporting step.

17. The method of claim 16 wherein the first identification device and the second identification device comprise a single radio identification device.

18. The method of claim 16 wherein the first process tool and the second process tool comprise perforating tools.

19. A method for performing a perforating process in a well comprising:

providing a casing in the well having an outside diameter and an inside diameter;

providing a perforating tool on the outside diameter of the casing;

providing a first device in the well configured to control the perforating tool;

providing a second device configured to transmit a code signal to the first device;

transporting the second device through the inside diameter of the casing proximate to the first device; and controlling the perforating tool responsive to the first device receiving the code signal from the second device during the transporting step.

20. The method of claim 19 further comprising conveying the perforating tool to a selected depth in the well on the casing.

21. The method of claim 19 wherein the first device is attached to the casing proximate to the perforating tool.

22. The method of claim 19 wherein the first device is attached to the perforating tool.

23. A method for performing a perforating process in a well having well casing positioned therein, the method comprising:

providing a perforating tool in the well configured to perforate the well casing;

providing a first device in the well in signal communication with the perforating tool and configured to transmit and receive rf signals;

providing a second device configured to generate a unique rf code signal responsive to rf signals from the first device;

transporting the second device through the casing proximate to the first device; and controlling the perforating tool responsive to reception of the unique rf code signal by the first device during the transporting step.

24. The method of claim 23 wherein providing the perforating tool comprises attaching the perforating tool to an outside diameter of the casing.

25. The method of claim 23 wherein providing the well casing comprises lowering a plurality of attached tubulars into the well, and providing the perforating tool comprises attaching the perforating tool to at least one of the tubulars.

26. The method of claim 23 wherein the perforating tool is configured to perforate the casing from an outside diameter thereof.

27. A method for performing a perforating process in a well bore having casing positioned therein comprising:

providing a perforating tool on the outside diameter of the casing by attaching the perforating tool to at least one of a plurality of tubulars that comprise the casing;

providing a reader device on the casing configured to control the perforating tool;

providing an identification device configured to transmit a unique rf code signal to the reader device;

transporting the identification device through the inside diameter of the casing proximate to the reader device; and actuating the perforating tool to perforate the casing responsive to the reader device receiving the unique rf code signal from the identification device during the transporting step.

28. The method of claim 27 wherein providing the reader device comprises providing a collar for the tubulars comprising an electrically non conductive window and attaching the reader device to the collar proximate to the window.

29. The method of claim 27 wherein the transporting step is performed by pumping a fluid through the inside diameter of the casing.

30. The method of claim 27 wherein the transporting step is performed by dropping the reader device by gravity through the inside diameter of the casing.

31. The method of claim 27 wherein the transporting step is performed by attaching the reader device to a robot and moving the robot through the inside diameter of the casing.

32. A method for performing a perforating process in a well comprising:

attaching a perforating tool to an outside diameter of a tubular, said perforating tool comprising a plurality of charge assemblies and a reader device configured to initiate a detonation sequence for the charge assemblies;

attaching the tubular to a plurality of tubulars and lowering the tubular with the perforating tool attached thereto to a selected depth in the well to form a well casing;

transporting an identification device through the well casing proximate to the reader device, said identification device configured to transmit a unique code signal to the reader device;

transmitting the unique code signal to the reader device during the transporting step; and initiating the detonation sequence to perforate the casing responsive to reception of the unique code signal by the reader device.

33. The method of claim 32 further comprising attaching a second perforating tool to the casing and transmitting a second identification device through the casing to initiate detonation of the second perforating tool.

34. The method of claim 32 wherein the casing comprises a coupling for attaching the perforating tool comprising an electrically non conductive window for the reader device.

35. The method of claim 32 wherein the identification device comprises a radio identification device and the unique code signal comprises an rf signal.

36. The method of claim 32 wherein the perforating tool comprises a hydraulic detonator and a perforating gun configured to establish fluid communication between the hydraulic detonator and the well casing during the detonation sequence.

37. The method of claim 32 further comprising providing a valve in the casing and closing the valve responsive to reception of the unique code signal by the reader device.

38. The method of claim 32 further comprising providing a valve in the casing responsive to a pressure generated by detonation of the charge assemblies and sealing the casing using the valve.

39. A system for performing an operation in a well comprising:

a process tool located at a selected depth within the well;

an identification device configured for transport through the well proximate to the process tool, and configured to transmit an rf code signal upon reception of rf transmission signals; and a reader device in the well comprising a transmitter configured to transmit the rf transmission signals, a receiver configured to receive the rf code signal from the identification device, and a control circuit configured to control the process tool responsive to reception of the rf code signal by the receiver.

40. The system of claim 39 wherein reader device is attached to the process tool.

41. The system of claim 39 wherein the well comprises a casing and the process tool is attached to the casing.

42. The system of claim 39 wherein the well comprises a casing and the reader device is attached to the casing.

43. A system for performing an operation in a well comprising:

a well casing;

a tool attached to the casing at a selected depth within the well;

a reader device attached to the well casing, or to the tool, the reader device in signal communication with the tool and configured to transmit and receive rf signals and to control the tool responsive to reception of a unique rf signal; and an identification device configured for transport through the casing and to generate the unique rf signal responsive to the rf signals from the reader device.

44. The system of claim 43 wherein the reader device comprises a transmitter for transmitting the rf signals, a receiver for receiving the unique rf signal, and a control circuit for controlling the tool.

45. The system of claim 44 wherein the tool comprises a perforating tool attached to an outside diameter of the casing.

46. The system of claim 45 further comprising a valve on the casing responsive to pressure generated during detonation of the perforating tool.

47. The system of claim 46 further comprising a perforating gun in signal communication with the reader device and configured to perforate the casing to initiate a detonation sequence for the perforating tool.

48. A system for performing a perforating process in a well comprising:

a well casing having an inside diameter and an outside diameter;

a perforating tool attached to the outside diameter comprising a charge assembly configured to perforate the well casing;

an identification device configured for transport through the inside diameter and configured to generate a unique rf signal;

a reader device on the tool, or on the casing proximate to the tool, the reader device comprising a receiver for receiving the unique rf signal, and a control circuit for controlling the charge assembly responsive to reception of the unique rf signal.

49. The system of claim 48 further comprising a collar configured to attach the reader device to the casing comprising an electrically non conductive material to permit signal transmission between the reader device and the identification device.

50. The system of claim 48 further comprising a valve on the casing configured to seal the casing upon detonation of the charge assembly.

51. The system of claim 48 wherein the perforating tool comprises a hydraulic detonator operable by fluid pressure transmitted through the inside diameter of the casing.

52. The system of claim 48 wherein the perforating tool comprises a hydraulic detonator operable by fluid pressure transmitted through the inside diameter of the casing and a perforating gun configured to perforate the casing to establish fluid communication between the hydraulic detonator and the casing.

53. A system for performing a perforating process in a well comprising:

a well casing;

a perforating tool attached to the casing comprising a charge assembly configured to perforate the casing and a hydraulic detonator assembly configured to detonate the charge assembly;

a perforating gun attached to the casing configured to perforate the casing to establish fluid communication between the casing and the hydraulic detonator;

a detonator on the casing configured to fire the perforating gun;

an identification device configured for transport through the casing proximate to the tool, and configured to transmit an rf code signal upon reception of rf transmission signals; and a reader device on the tool comprising a transmitter configured to transmit the rf transmission signals, a receiver configured to receive the rf code signal from the identification device, and a control circuit configured to actuate the detonator to fire the perforating gun responsive to reception of the rf code signal by the receiver.

54. The system of claim 53 further comprising a pressure tank on the casing operable by pressure generated during detonation of the perforating tool and a valve on the casing operable by the pressure tank.

55. The system of claim 54 wherein the valve comprises a flapper valve within the casing.

56. The system of claim 55 wherein the reader device comprises a transmitter for transmitting the rf signals, a receiver for receiving the rf code signal, and a control circuit for transmitting a control signal to the perforating gun.

57. The system of claim 56 further comprising a collar configured to attach the reader device to the casing comprising an electrically non conductive material to permit signal transmission between the reader device and the identification device.

58. The system of claim 57 wherein the electrically non conductive material comprises a plastic window.

59. A method for improving production in an oil or gas well comprising:

providing a process tool in the well configured to perform the operation;

providing a first device in the well in signal communication with the process tool and configured to transmit and receive rf signals;

providing a second device configured to generate a unique rf signal responsive to rf signals from the first device;

programming the first device to control the process tool upon reception of the unique rf signal from the second device;

transporting the second device through the well proximate to the first device; and controlling the process tool responsive to reception of the unique rf signal by the first device during the transporting step.

60. The method of claim 59 wherein the first device comprises a radio frequency reader device.

61. The method of claim 59 wherein the second device comprises a radio frequency identification device.

62. The method of claim 59 wherein the process tool comprises a casing conveyed perforating tool.

63. The method of claim 59 wherein the process tool comprises a tubing conveyed packer setting tool.

64. A method for performing an operation in a well having a process tool and a reader device positioned therein, said reader device being in signal communication with the process tool and configured to transmit and receive rf signals, the method comprising:

transporting an identification device through the well, said identification device being configured to generate a unique rf code signal responsive to transmission signals from the reader device.

65. The method of claim 64 further comprising:

transmitting a control signal from the reader device to the process tool upon reception of the unique rf code signal from the identification device so as to control the process tool.

* * * * *